US008565638B2

(12) United States Patent
Kikuchi et al.

(10) Patent No.: US 8,565,638 B2
(45) Date of Patent: Oct. 22, 2013

(54) UNIT AND ELECTROPHOTOGRAPHIC IMAGE FORMING APPARATUS

(75) Inventors: Ken Kikuchi, Mishima (JP); Tsutomu Nishiuwatoko, Numazu (JP); Takashi Akutsu, Odawara (JP)

(73) Assignee: Canon Kabushiki Kaisha, Tokyo (JP)

( * ) Notice: Subject to any disclaimer, the term of this patent is extended or adjusted under 35 U.S.C. 154(b) by 269 days.

(21) Appl. No.: 12/975,998

(22) Filed: Dec. 22, 2010

(65) Prior Publication Data

US 2011/0158681 A1 Jun. 30, 2011

(30) Foreign Application Priority Data

Dec. 24, 2009 (JP) ..... 2009-292805
Oct. 25, 2010 (JP) ..... 2010-238733

(51) Int. Cl.
*G03G 21/18* (2006.01)

(52) U.S. Cl.
USPC ..... 399/111; 399/119; 399/262

(58) Field of Classification Search
USPC ..... 399/111
See application file for complete search history.

(56) References Cited

U.S. PATENT DOCUMENTS 5,331,373 A * 7/1994 Nomura et al. ..... 399/111
5,585,902 A 12/1996 Nishiuwatoko et al.
5,729,796 A 3/1998 Miura et al.
5,768,658 A 6/1998 Watanabe et al.
5,815,644 A 9/1998 Nishiuwatoko et al.
5,870,655 A 2/1999 Nishiuwatoko et al.
5,893,006 A 4/1999 Kanno et al.
5,937,240 A 8/1999 Kanno et al.
5,943,528 A 8/1999 Akutsu et al.
5,963,759 A * 10/1999 Kojima et al. ..... 399/111
5,966,566 A 10/1999 Odagawa et al.
6,009,288 A 12/1999 Akutsu
6,070,029 A 5/2000 Nishiuwatoko et al.
6,078,764 A 6/2000 Akutsu
6,115,569 A 9/2000 Akutsu
6,137,971 A 10/2000 Sasaki et al.
6,137,973 A 10/2000 Nishiuwatoko et al.
6,141,508 A 10/2000 Sasaki et al.

(Continued)

FOREIGN PATENT DOCUMENTS

JP 60179753 A * 9/1985
JP 2005274652 A * 10/2005

(Continued)

*Primary Examiner* — Clayton E LaBalle
*Assistant Examiner* — Leon W Rhodes, Jr.
(74) *Attorney, Agent, or Firm* — Fitzpatrick, Cella, Harper & Scinto

(57) ABSTRACT

A unit detachably mountable to a main assembly of an image forming apparatus including an openable member capable of opening and closing a unit mounting and demounting opening includes: a grip portion, provided rotatably about a rotational shaft on a side wall of a frame of the unit, being rotatably moved to a projected position in which the grip portion is projected from the side wall and to a retracted position in which the grip portion is retracted in a longitudinal direction so as to be closer to the side wall than the projected position; and a force receiving portion at which the grip portion located at the projected position receives a force from the openable member when the openable member is closed in a state in which the unit is mounted in the main assembly, the force receiving portion being configured to receive the force for rotating the grip portion from the projected position to the retracted position.

15 Claims, 22 Drawing Sheets

(56) References Cited

U.S. PATENT DOCUMENTS

| | | | | |
|---|---|---|---|---|
| 6,493,527 | B1 * | 12/2002 | Higeta et al. | 399/111 |
| 6,704,522 | B2 | 3/2004 | Sasago et al. | |
| 6,714,746 | B2 | 3/2004 | Morioka et al. | |
| 6,735,405 | B2 | 5/2004 | Yokoi et al. | |
| 6,832,057 | B2 | 12/2004 | Oguma et al. | |
| 6,901,229 | B2 | 5/2005 | Nishiuwatoko et al. | |
| 6,952,544 | B2 | 10/2005 | Kikuchi et al. | |
| 7,073,251 | B2 | 7/2006 | Kikuchi et al. | |
| 7,079,787 | B2 | 7/2006 | Ogino et al. | |
| 7,242,888 | B2 * | 7/2007 | Ishii | 399/110 |
| 7,296,341 | B2 | 11/2007 | Kikuchi et al. | |
| 7,321,739 | B1 * | 1/2008 | Dawson et al. | 399/90 |
| 7,817,936 | B2 | 10/2010 | Kikuchi et al. | |
| 7,983,597 | B2 * | 7/2011 | Kikuchi | 399/111 |
| 2010/0074646 | A1 * | 3/2010 | Miyahara et al. | 399/99 |
| 2010/0080615 | A1 | 4/2010 | Kikuchi | |
| 2010/0135691 | A1 | 6/2010 | Kikuchi | |
| 2011/0033201 | A1 | 2/2011 | Akutsu et al. | |
| 2011/0058846 | A1 | 3/2011 | Hirukawa et al. | |

FOREIGN PATENT DOCUMENTS

| | | | |
|---|---|---|---|
| JP | 2008090121 A | * | 4/2008 |
| JP | 2008-286829 | | 11/2008 |
| JP | 2008286829 A | * | 11/2008 |

* cited by examiner (a)

(b)

(a)

(b)

(a)

(b)

(a)

(b)

UNIT AND ELECTROPHOTOGRAPHIC IMAGE FORMING APPARATUS

FIELD OF THE INVENTION AND RELATED ART

The present invention relates to a unit detachably mounted to a main assembly of an image forming apparatus and an image forming apparatus for forming an image on a recording material, wherein the unit is dismountably mounted to the apparatus main assembly.

Here, the image forming apparatus forms an image on the recording material using, e.g., an electrophotographic image forming process. The examples of the electrophotographic image forming apparatus include an electrophotographic copying machine, an electrophotographic printer (a laser beam printer, an LED printer, for example), a facsimile device, and a word processor. The image is formed by the electrophotographic image forming apparatus on a recording material, and the recording material is paper, an OHP sheet, for example.

The unit is, e.g., a process cartridge, a developing cartridge or the like. The unit contributes to an image forming process for forming the image on the recording material in the state that it is mounted to the main assembly of the electrophotographic image forming apparatus. Here, the process cartridge contains at least one of the charging means, developing means, cleaning means as process means, and the electrophotographic photosensitive drum as a unit integrally, and it is dismountably mountable to the main assembly. The process cartridge may contain the developing means as the process means and the electrophotographic photosensitive drum as a unit, and it is dismountably mounted to the main assembly of the electrophotographic image forming apparatus. The process cartridge may contain the charging means, the developing means, or the cleaning means as the process means and the electrophotographic photosensitive drum as a unit, and it is dismountably mounted to the main assembly. The process cartridge which is provided integrally with the electrophotographic photosensitive drum and the developing means is called an integral-type process cartridge. The process cartridge which is provided integrally with, the electrophotographic photosensitive drum and the process means other than the developing means is called a discrete type process cartridge. In this case, the developing means is provided in a developing unit unintegral with the process cartridge, and the discrete type process cartridge forms the image using the combination with such a developing unit. The mounting and demounting of the process cartridge can be carried out relative to the main assembly by a user. For this reason, the maintenance of the apparatus is easy. The act of the process means is carried out on the electrophotographic photosensitive drum.

The developing cartridge is provided with a developing roller, contains a developer (toner) for developing an electrostatic latent image formed on the electrophotographic photosensitive drum, and is dismountably mounted to the main assembly. In the case of the developing cartridge, the electrophotographic photosensitive drum is mounted to a main assembly or a cartridge supporting member. Or, the electrophotographic photosensitive drum is provided in a so-called discrete type process cartridge In this case, the process cartridge is not provided with the developing means. The developing cartridge can be mounted and demounted relative to the main assembly by the user. For this reason, the maintenance of the apparatus is easy.

Therefore, the cartridge (unit) in this invention includes the process cartridges of a so-called the integral type or a so-called discrete type. The cartridge includes a combination of the so-called process cartridge of the discrete type and the developing cartridge. In another example of the cartridge, the electrophotographic photosensitive drum is mounted fixedly to the main assembly or the cartridge supporting member, and the detachably mountable developing cartridge acts on the electrophotographic photosensitive drum.

As has been described hereinbefore, the electrophotographic image forming apparatus for forming the image on the recording material using the electrophotographic image forming process is known. In this electrophotographic image forming apparatus, the process cartridge type described above is known. In addition, the developing cartridge type which comprises only the developing unit unintegral with the photosensitive drum is known. In the present invention, the process cartridge type and the developing cartridge type are usable. The process cartridge and the developing cartridge are provided with a developer accommodating portion which contains the developer (toner) for developing the electrostatic latent image.

In the case of the cartridge types described above, an exchanging operation of the cartridge is required to be performed by the user himself (herself) when the cartridge is mounted in the apparatus main assembly or lasts its lifetime. When the user handles the cartridge, in order to hold the cartridge with reliability, a grip portion or the like is provided at a part of the cartridge in some cases (Japanese Laid-Open Patent Application (JP-A) 2008-286829).

According to JP-A 2008-286829, when the cartridge is mounted into the apparatus main assembly, the user grips the grip portion projected retractably from the cartridge surface with respect to a longitudinal direction of the cartridge and then inserts the cartridge into the apparatus main assembly. Also when the cartridge is demounted from the apparatus main assembly, the user can take the cartridge out of the image forming apparatus by gripping the grip portion.

Thus, according to the constitution of the JP-A 2008-286829, by providing the cartridge with the grip portion retractable in the longitudinal direction, it becomes possible to downsize the apparatus main assembly and ensure a long length of the grip portion, so that the constitution is advantageous for the user. Further, U.S. Patent Publication No. US2010/0135691 discloses a constitution in which the retractable grip portion is provided with respect to a widthwise direction of the unit.

SUMMARY OF THE INVENTION

The present invention has further developed the conventional constitutions described above.

A principal object of the present invention is to provide a unit to be mounted in a main assembly of an image forming apparatus, in which usability of a user is improved.

Another object of the present invention is to provide an image forming apparatus including the unit.

According to an aspect of the present invention, there is provided a unit detachably mountable to a main assembly of an image forming apparatus including an openable member capable of opening and closing a unit mounting and demounting opening, the unit comprising:

a grip portion, provided rotatably about a rotational shaft on a side wall of a frame of the unit, being rotatably moved to a projected position in which the grip portion is projected from the side wall and to a retracted position in which the grip portion is retracted in a longitudinal direction so as to be closer to the side wall than the projected position; and a force receiving portion at which the grip portion located at the projected position receives a force from the openable member when the openable member is closed in a state in which the unit is mounted in the main assembly, the force receiving portion being configured to receive the force for rotating the grip portion from the projected position to the retracted position.

These and other objects, features, and advantages of the present invention will become more apparent upon consideration of the following description of the preferred embodiments of the present invention, taken in conjunction with the accompanying drawings.

Figure 3:
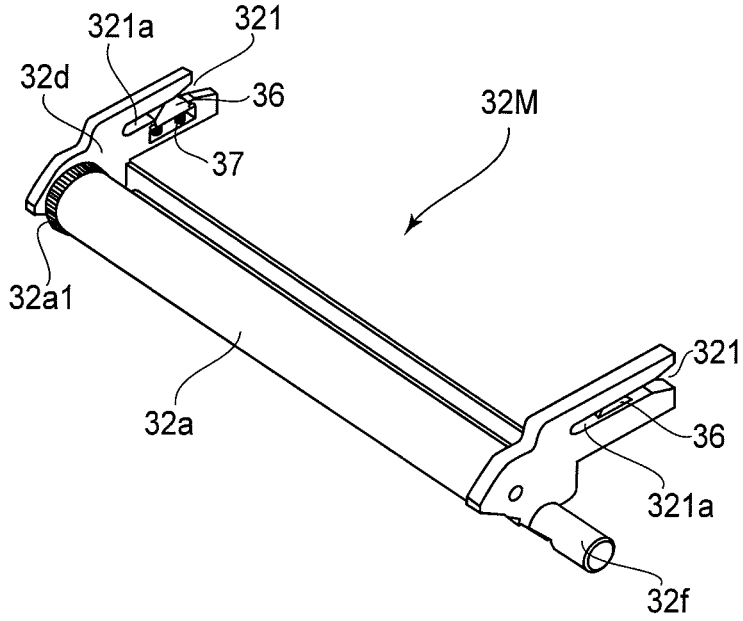
Figure 3:
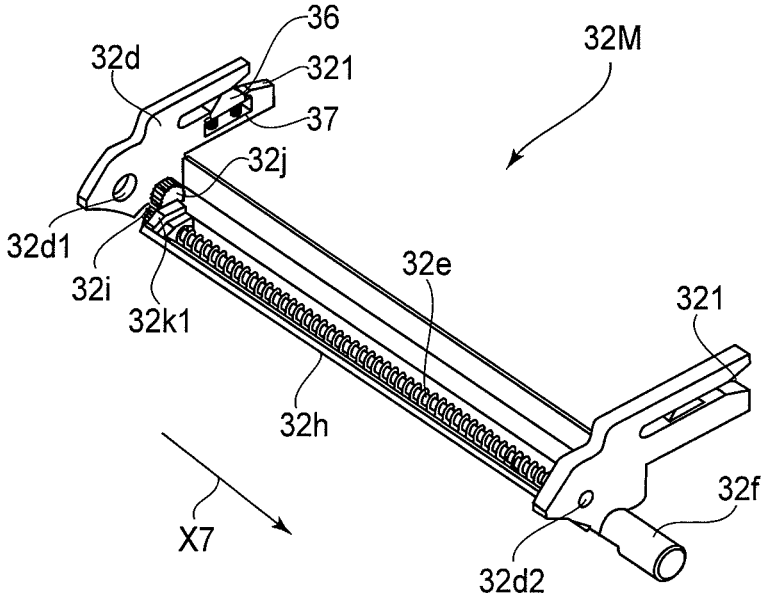

Part (a) of FIG. 3 is a left-hand side perspective view of one photosensitive member unit, and (b) is a perspective view of the photosensitive member unit (photosensitive member case) from which a drum, a charging roller, and a cleaning blade are dismounted.

Figure 4:
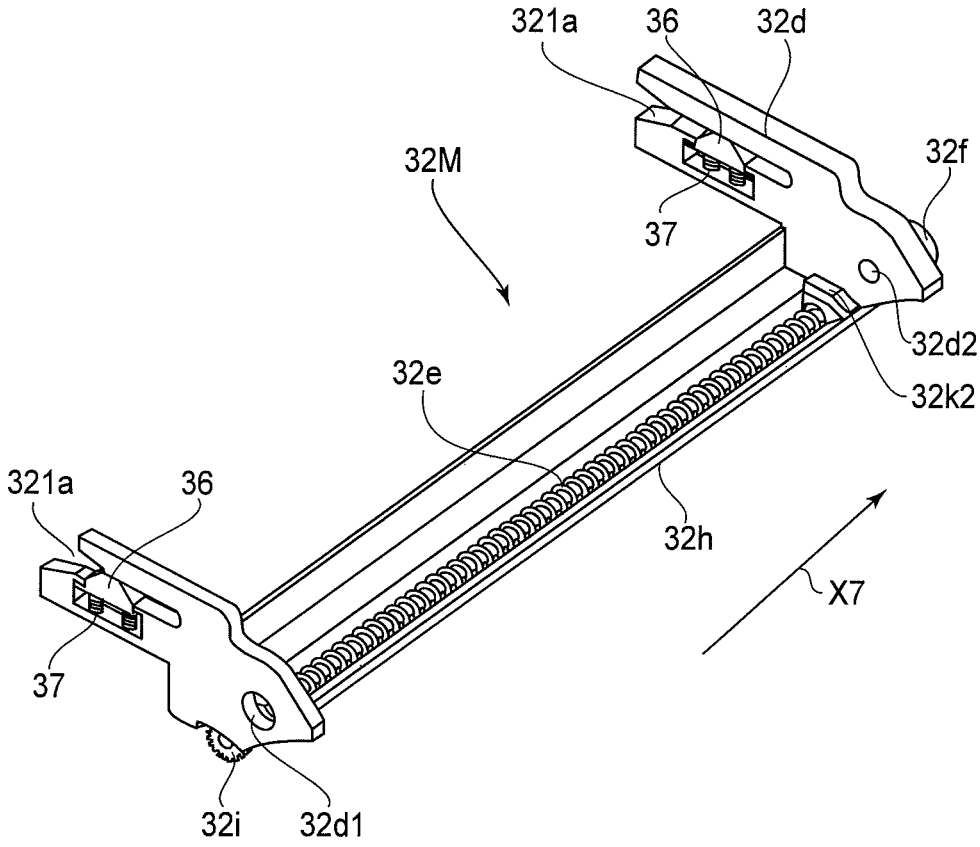

FIG. 4 is a right-hand side perspective view of the photosensitive member case of (b) of FIG. 3.

Figure 5:
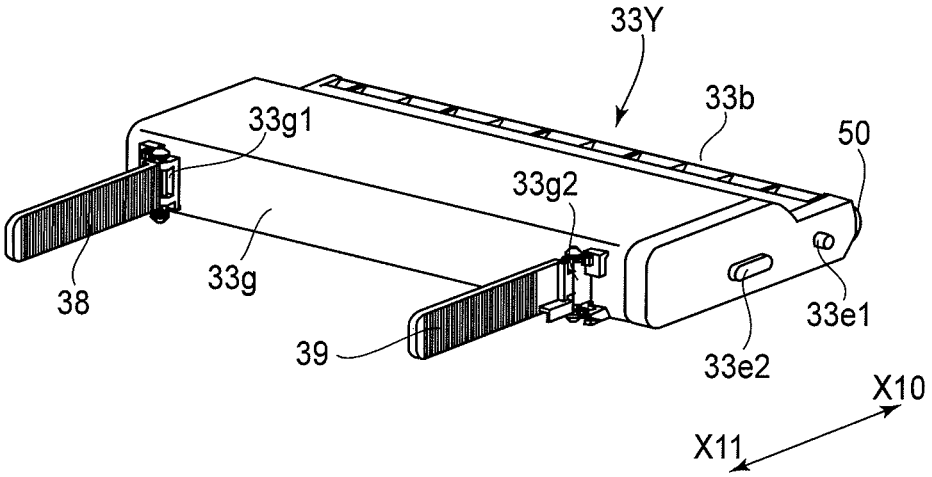
Figure 5:
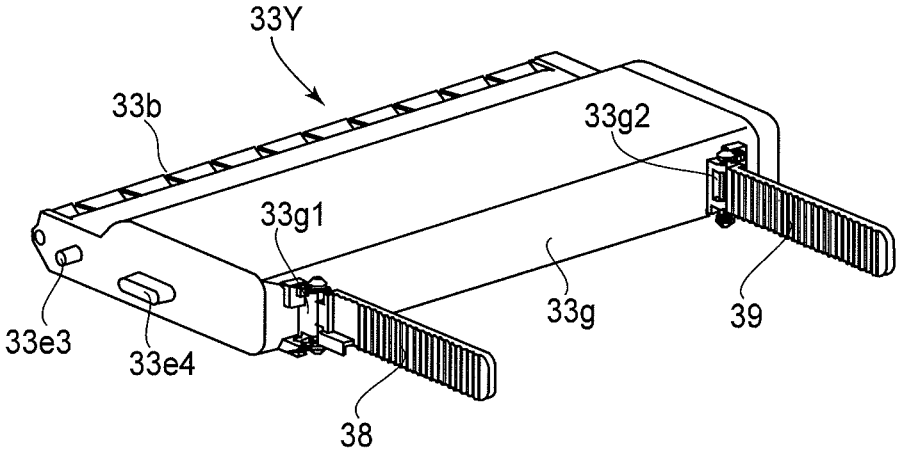

Part (a) of FIG. 5 is a right-hand side perspective view of a cartridge, and (b) is a left-hand side perspective view thereof.

Figure 6:
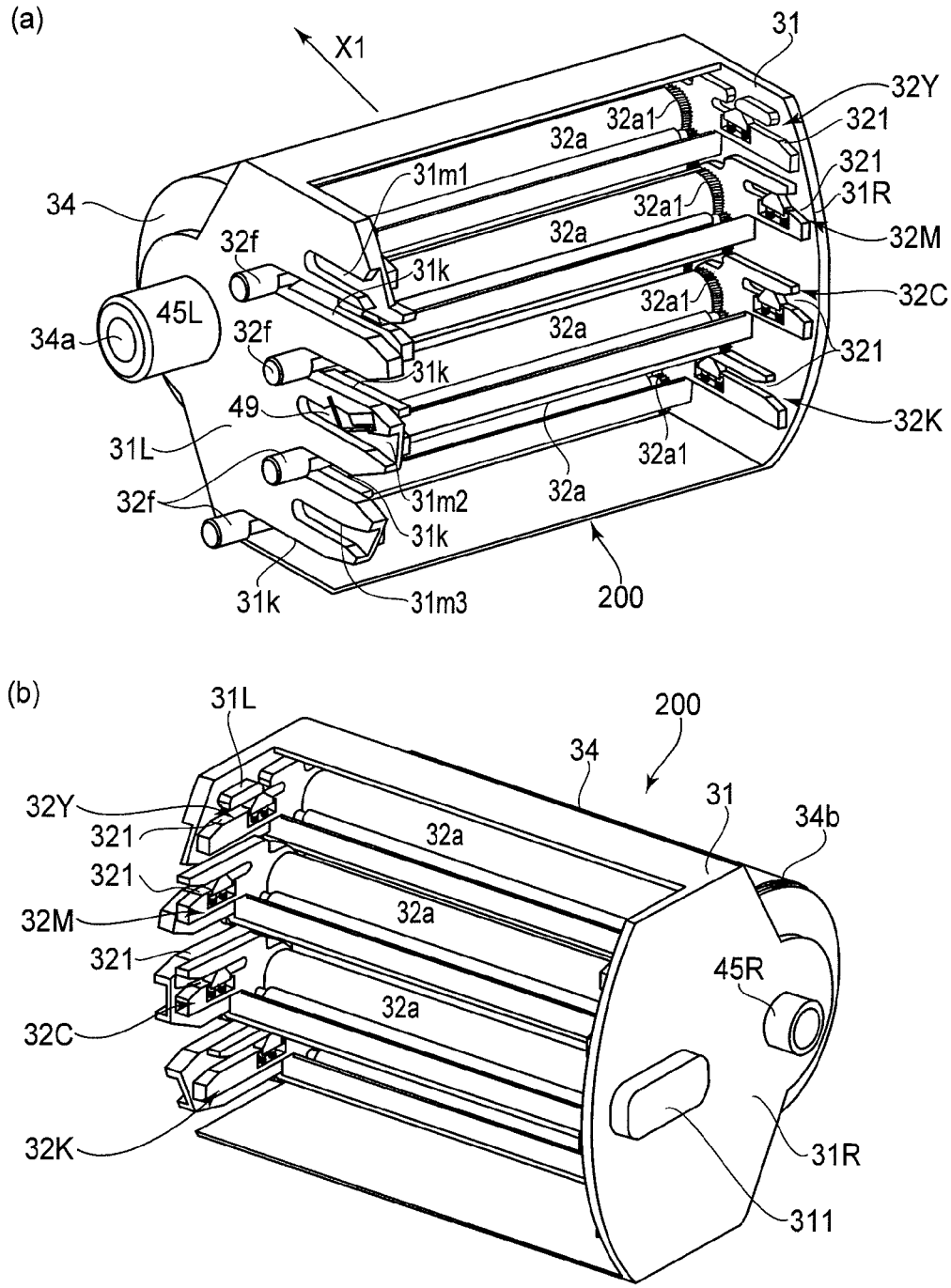

Part (a) of FIG. 6 is a left-hand side perspective view of an image forming unit, and, (b) is a right-hand side perspective view thereof.

Figure 7:
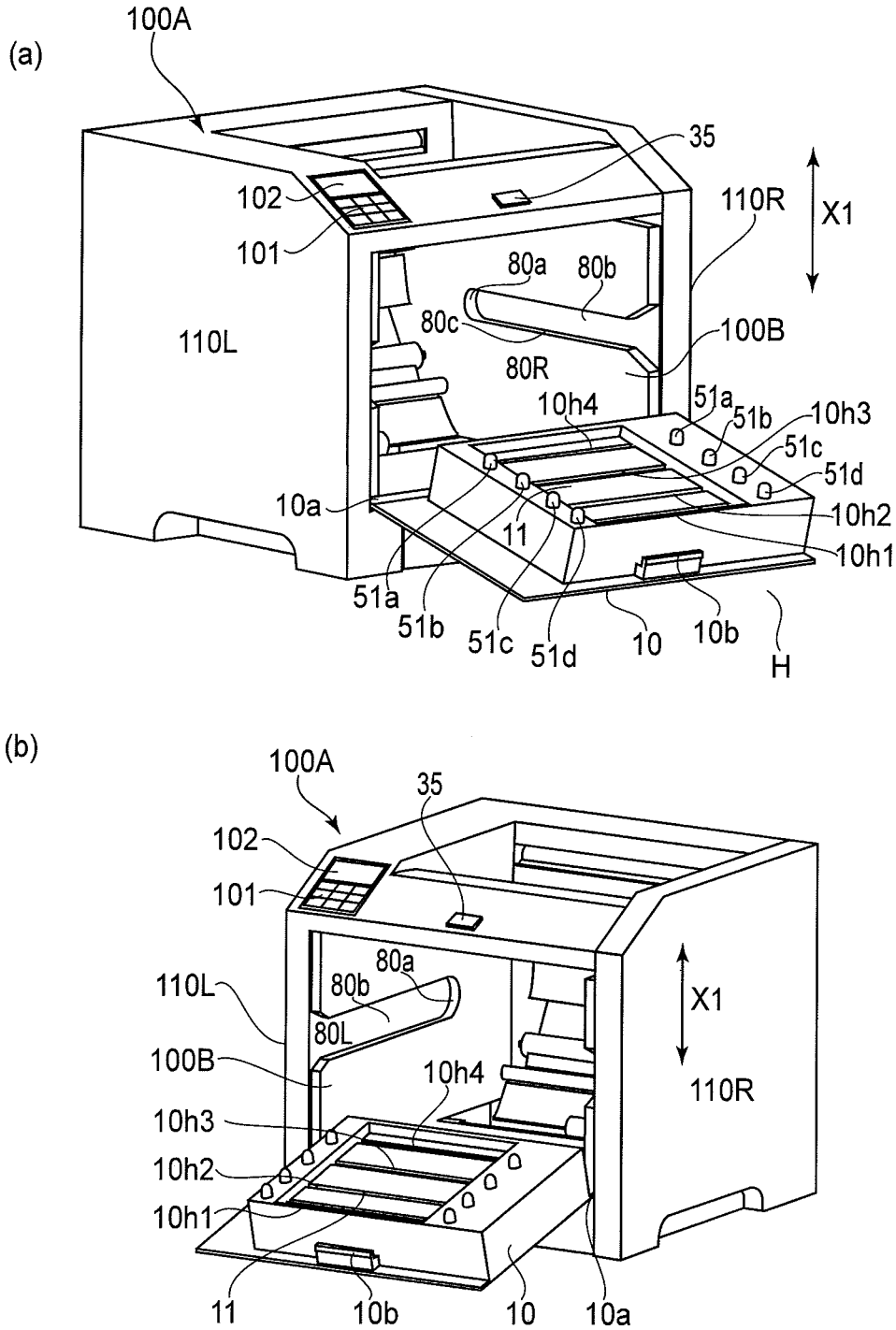

Part (a) of FIG. 7 is a left-hand side perspective view of a main assembly in the state that a cover is open, and (b) is a right-hand side perspective view thereof.

Figure 8:
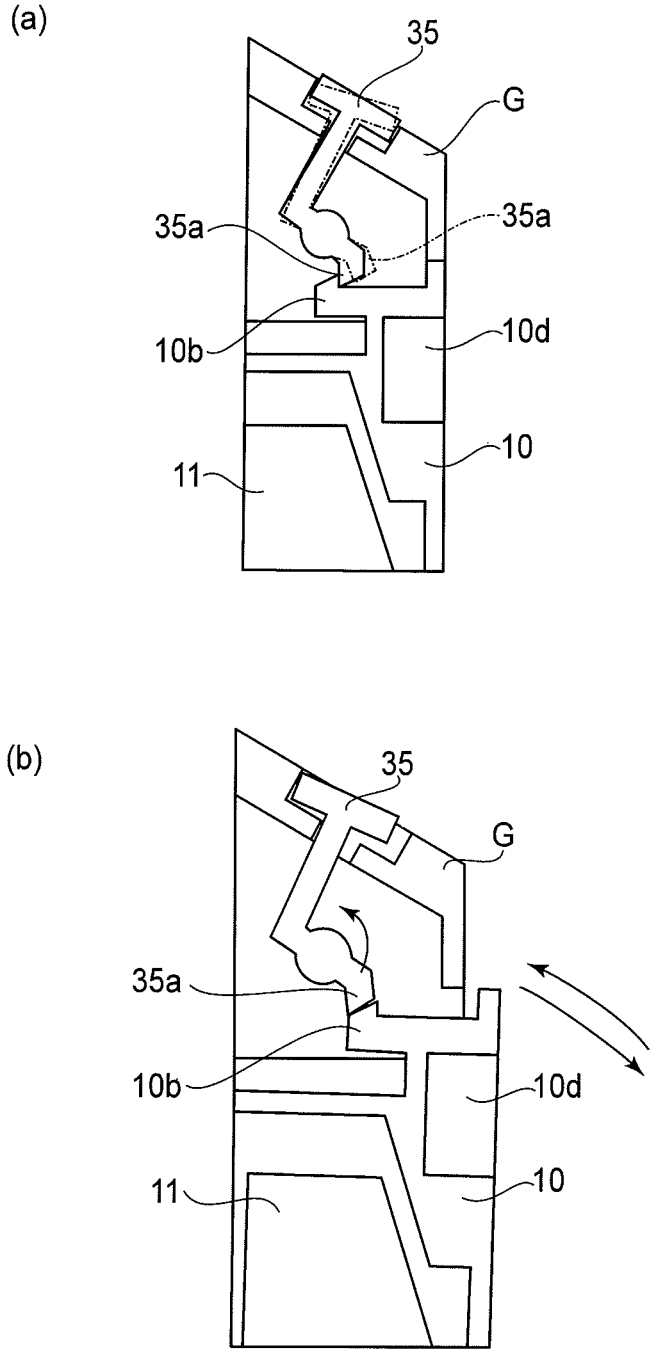

FIG. 8 is an illustration of a maintenance button.

Figure 9A:
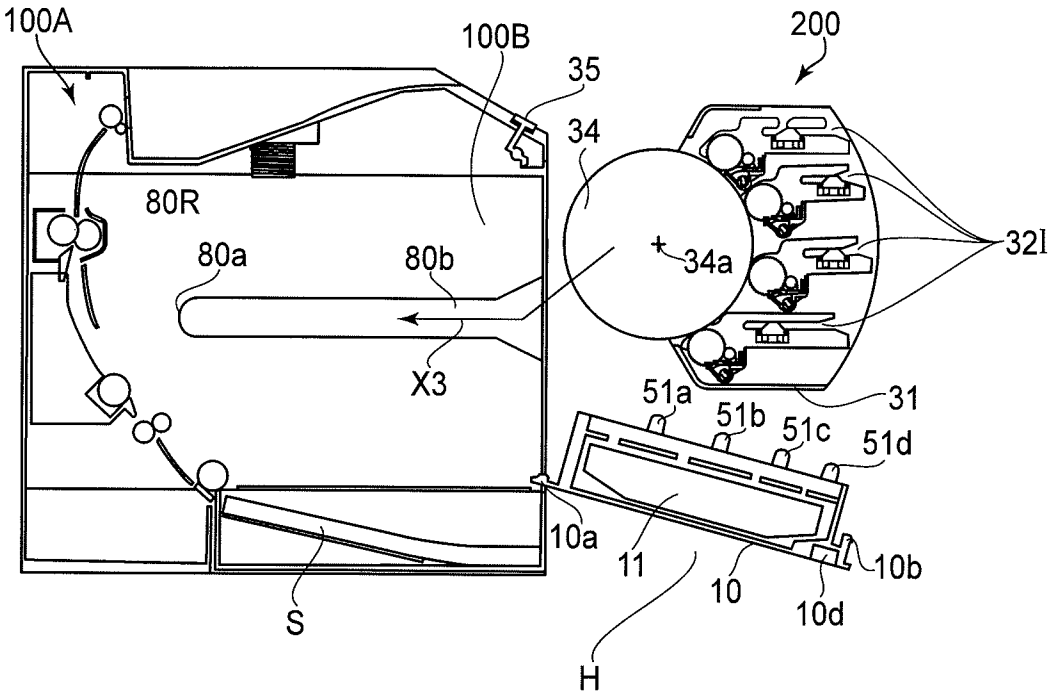
Figure 9B:
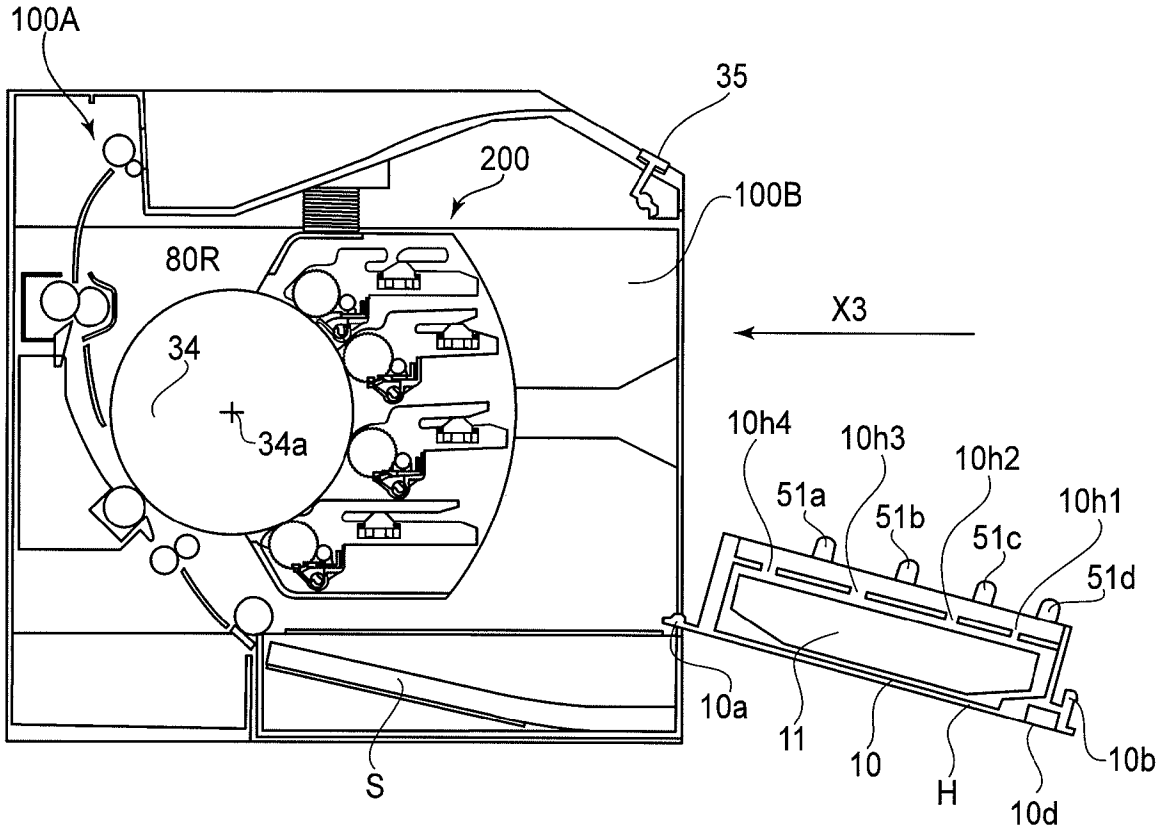

FIGS. 9A and 9B are illustrations of the mounting process of the image forming unit relative to the main assembly.

Figure 10A:
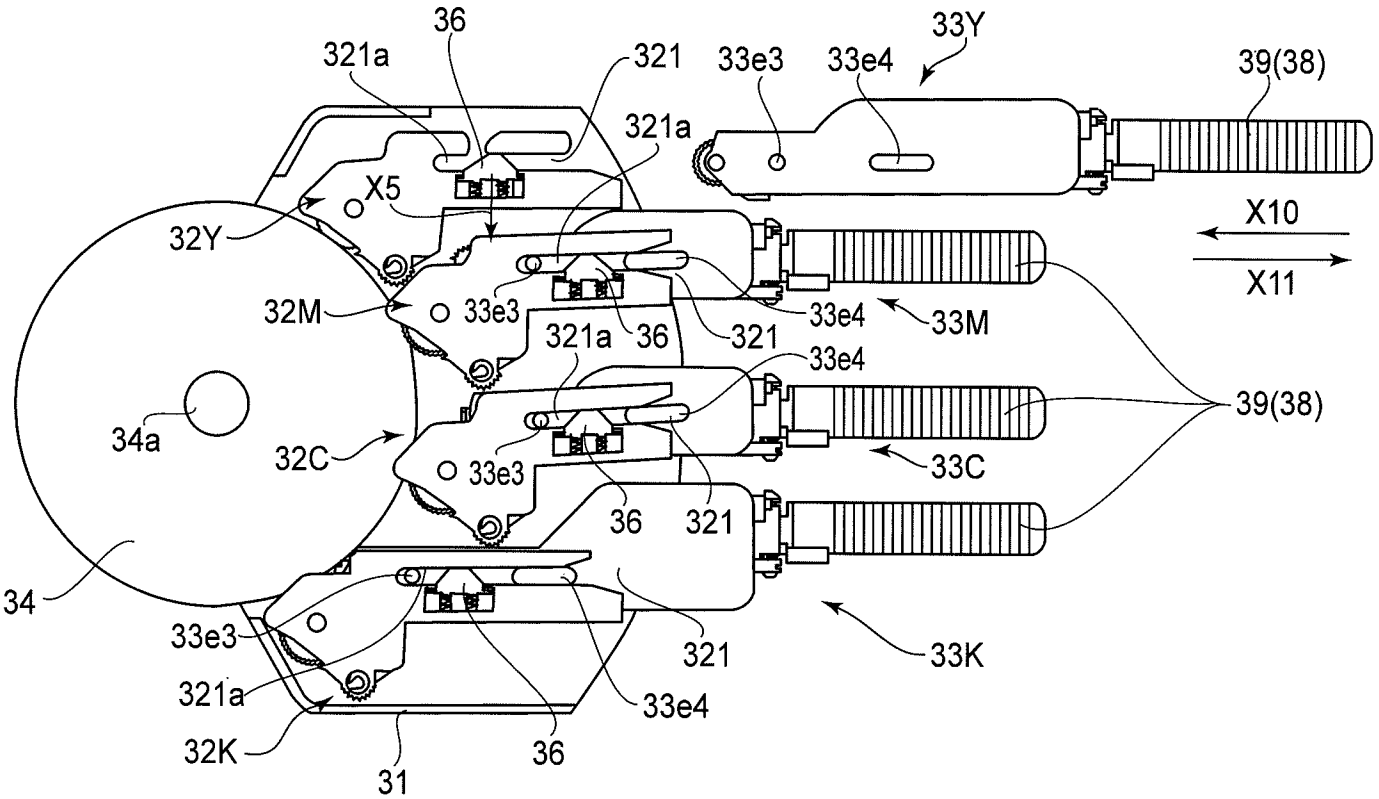
Figure 10B:
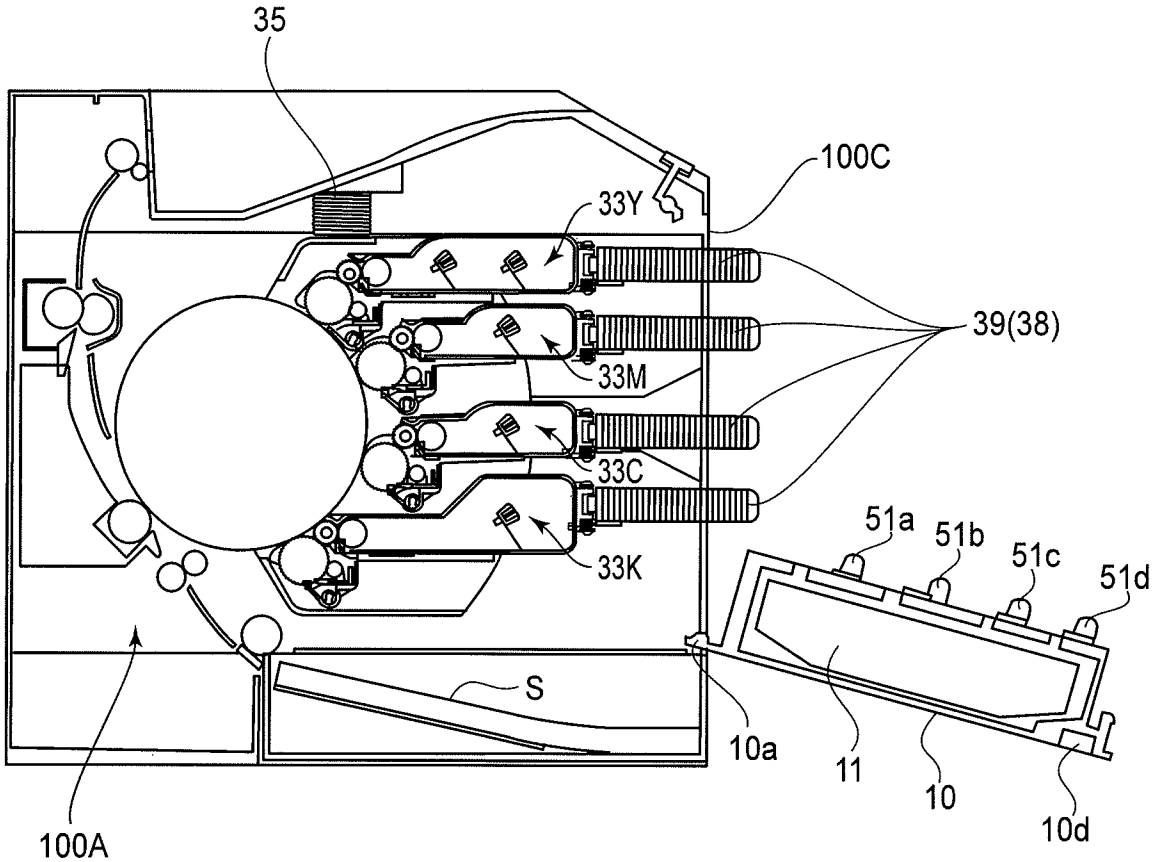

FIGS. 10A and 10B are illustrations of the mounting and demounting process of the cartridge relative to the image forming unit.

Figure 11:
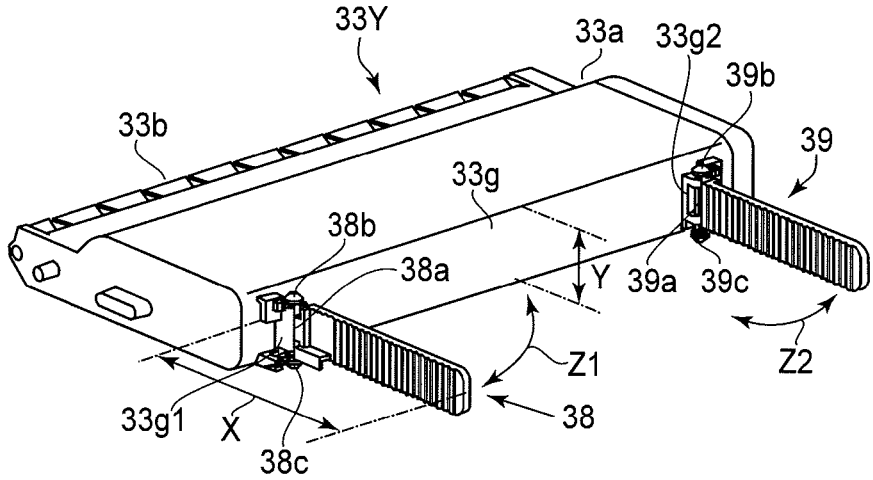
Figure 11:
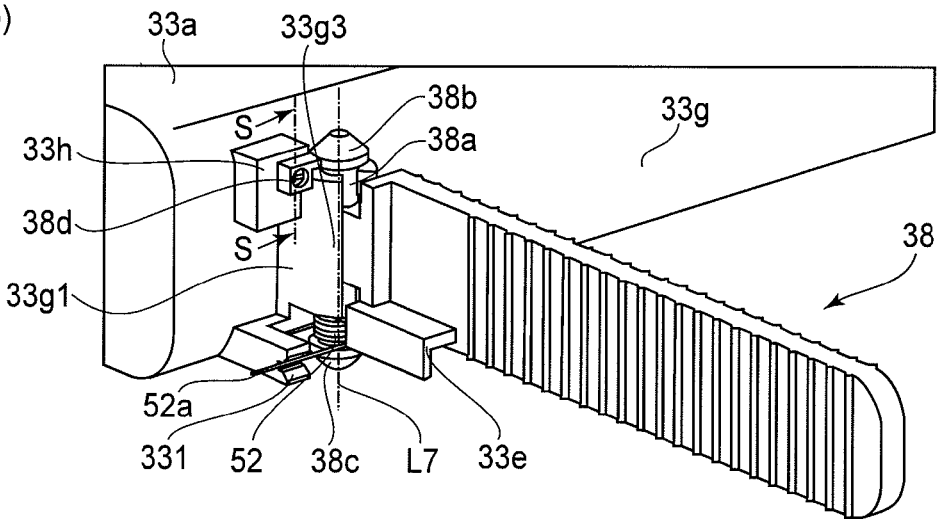

Part (a) of FIG. 11 is an illustration of a grip portion, and (b) is a detailed illustration thereof.

Figure 12:
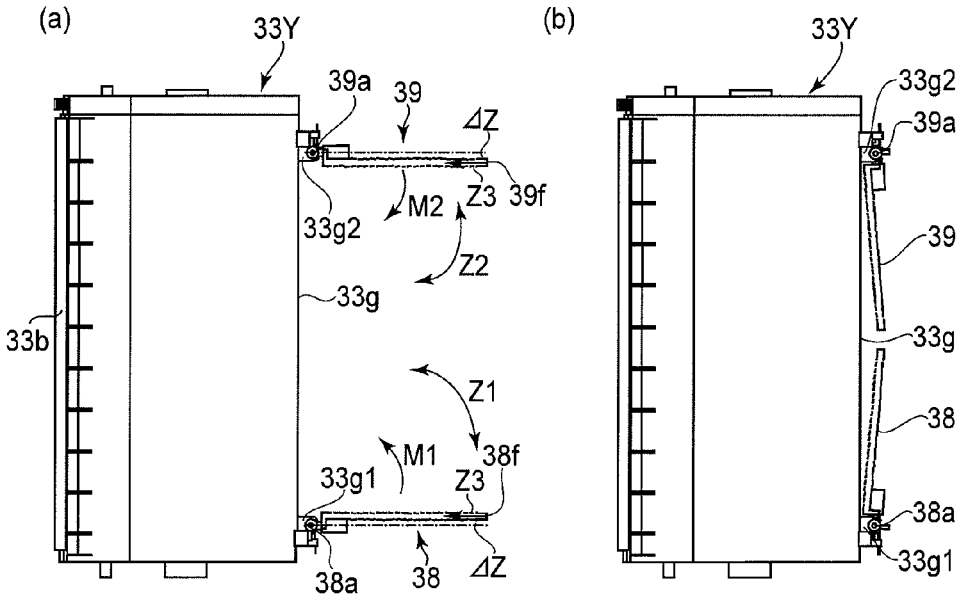

Part (a) of FIG. 12 is a top plan view when the grip portion is located at a projected position, and (b) is a top plan view when the grip portion is located at a retracted position.

Figure 13:
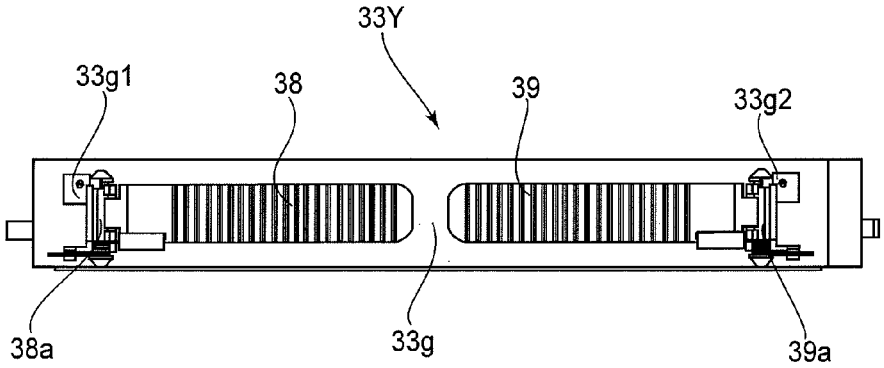

FIG. 13 is a front view when the grip portion is located at the retracted position.

Figure 14:
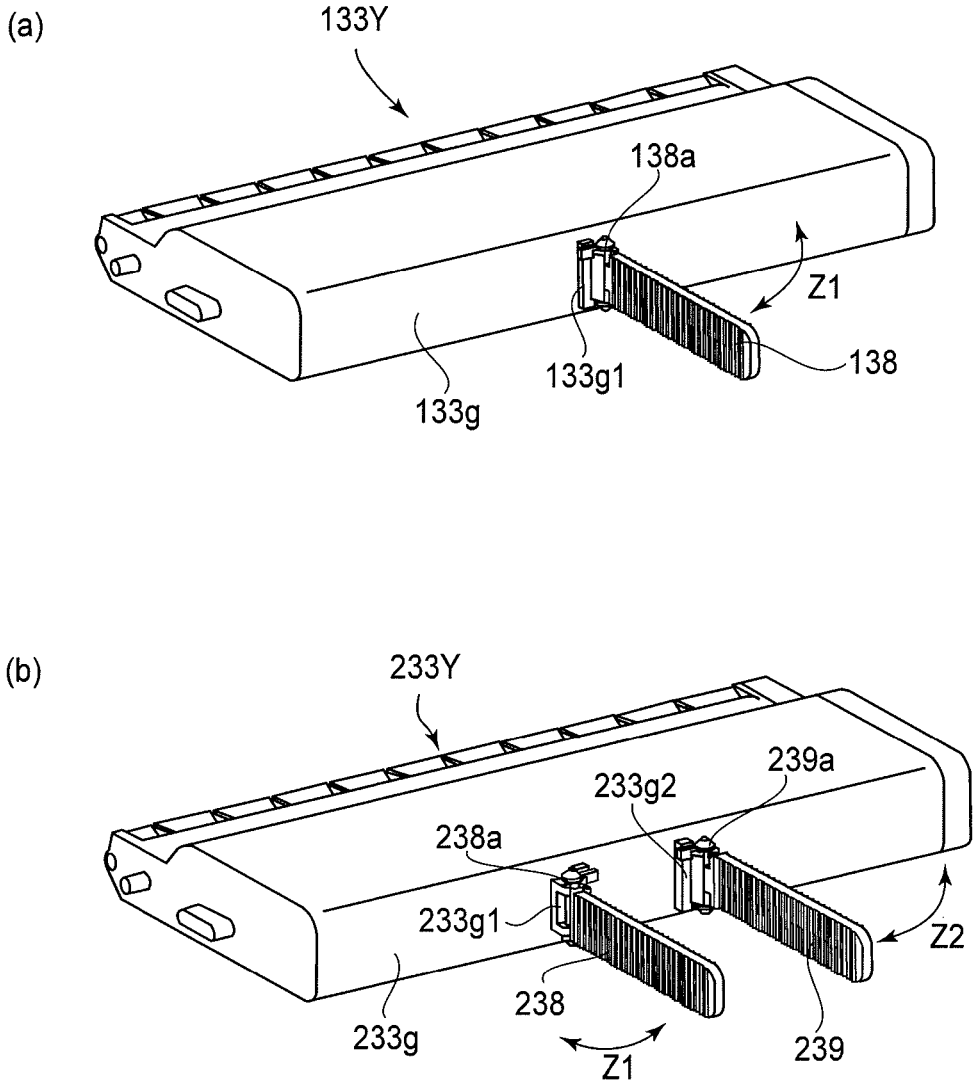

FIG. 14 is a perspective view showing another embodiment of the grip portion.

Figure 15:
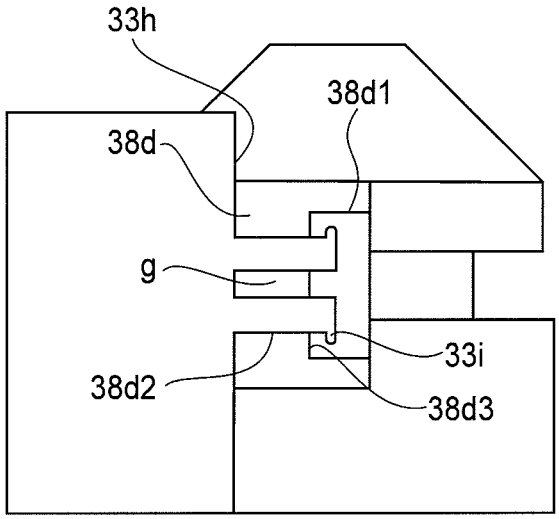
Figure 15:
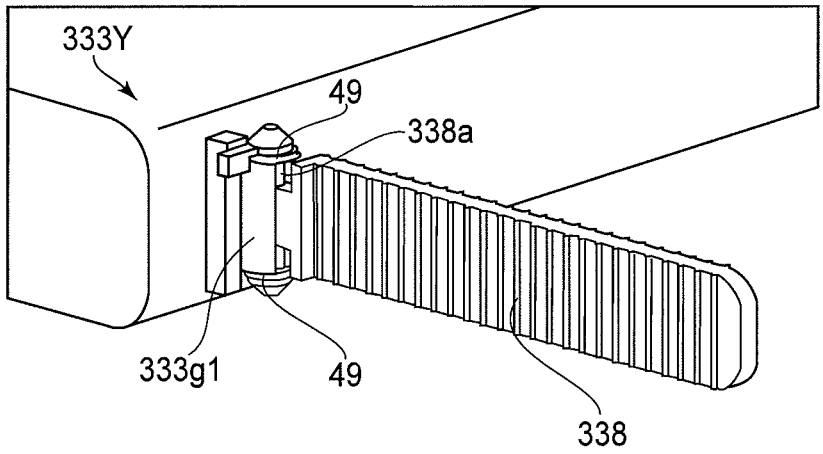

Part (a) of FIG. 15 is a sectional view showing a locking portion of the grip portion, and (b) is a perspective view showing another embodiment of the grip portion.

Figure 16:
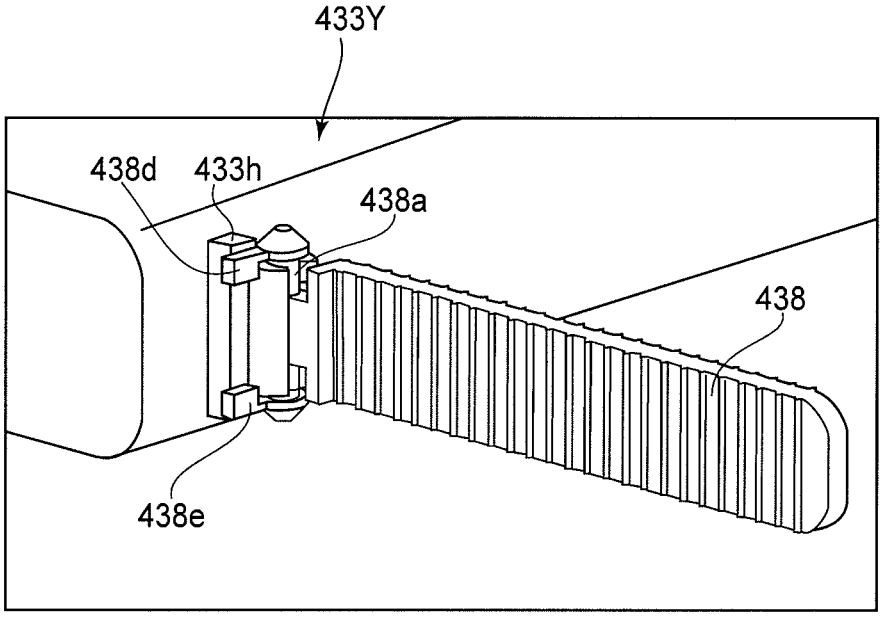
Figure 17:
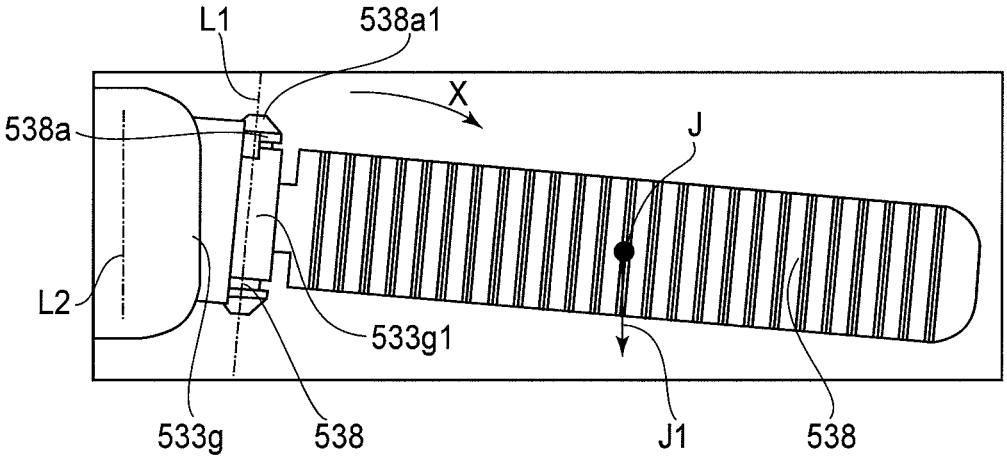

FIGS. 16 and 17 are perspective views each showing another embodiment of the grip portion.

Figure 18:
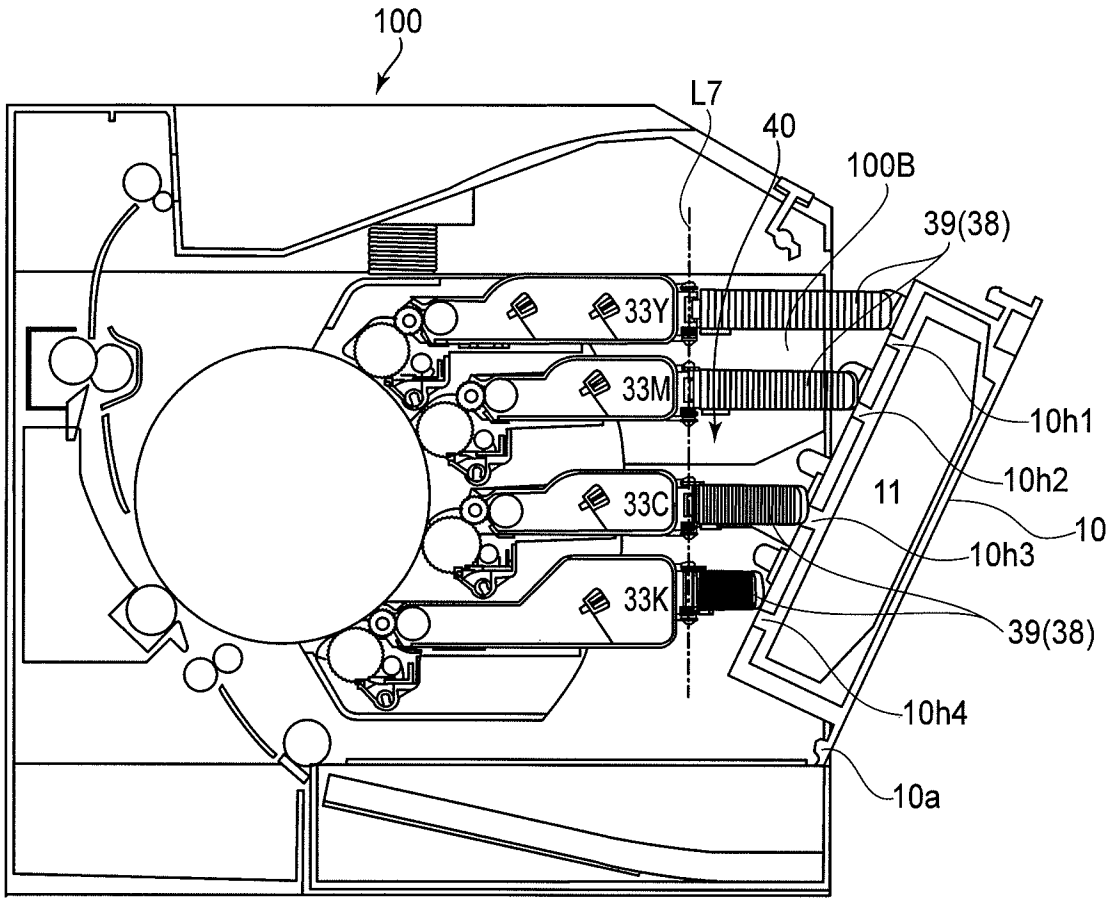

FIG. 18 is a sectional view for illustrating an operation state of the grip portion.

Figure 19A:
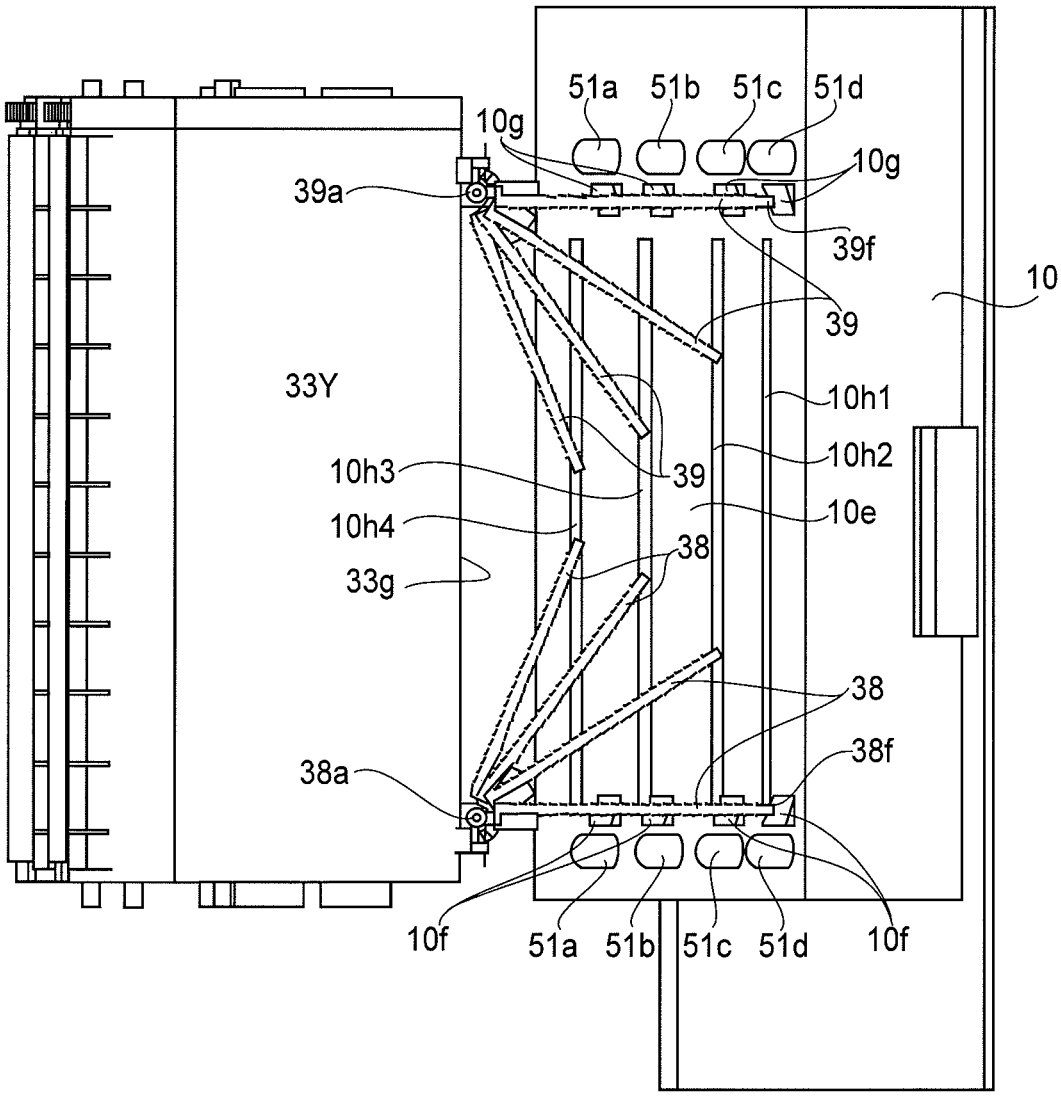
Figure 19B:
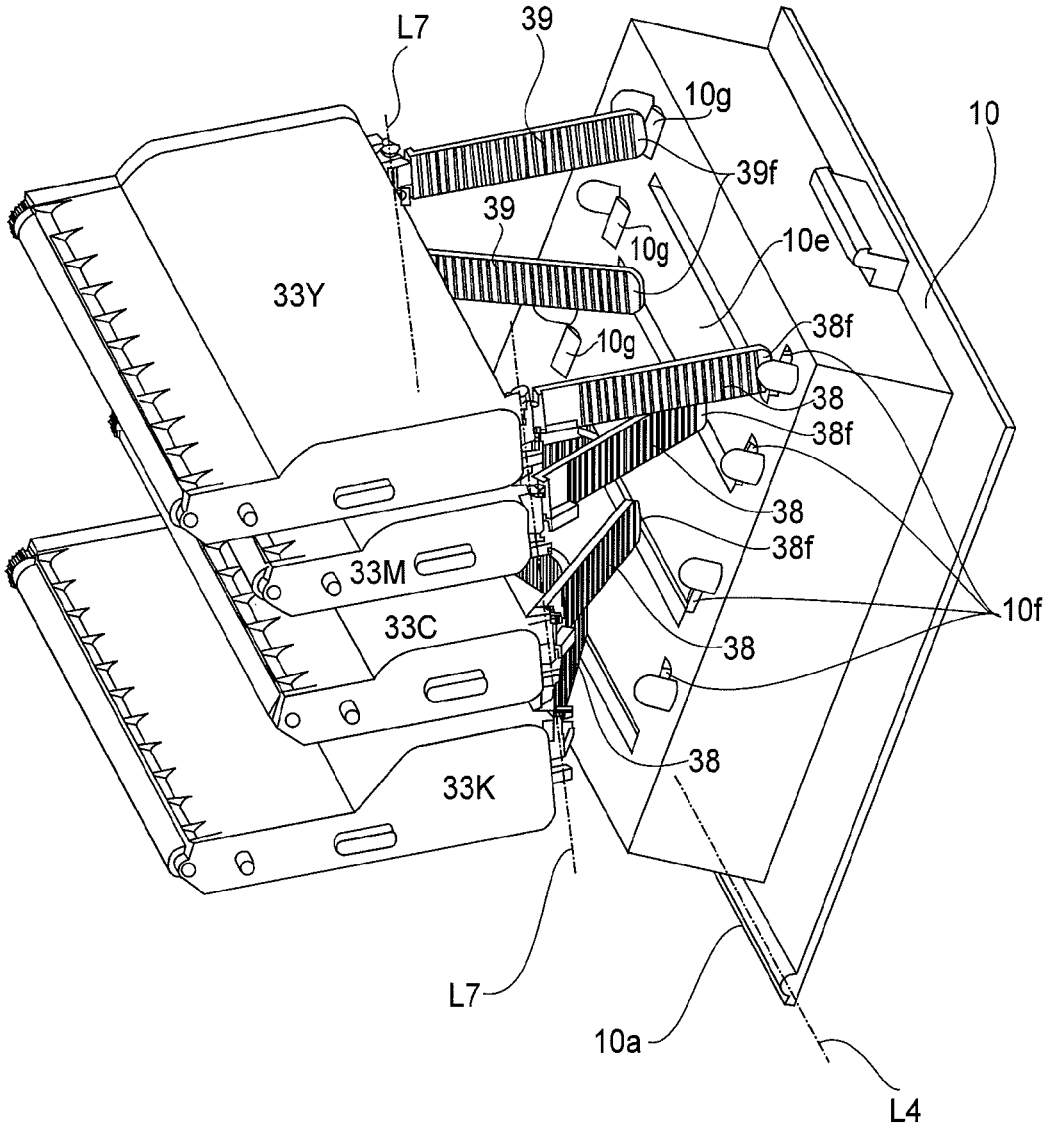

FIG. 19A is a top plan view for illustrating the operation state of the grip portion, and FIG. 19B is a perspective view of FIG. 19A.

Figure 20:
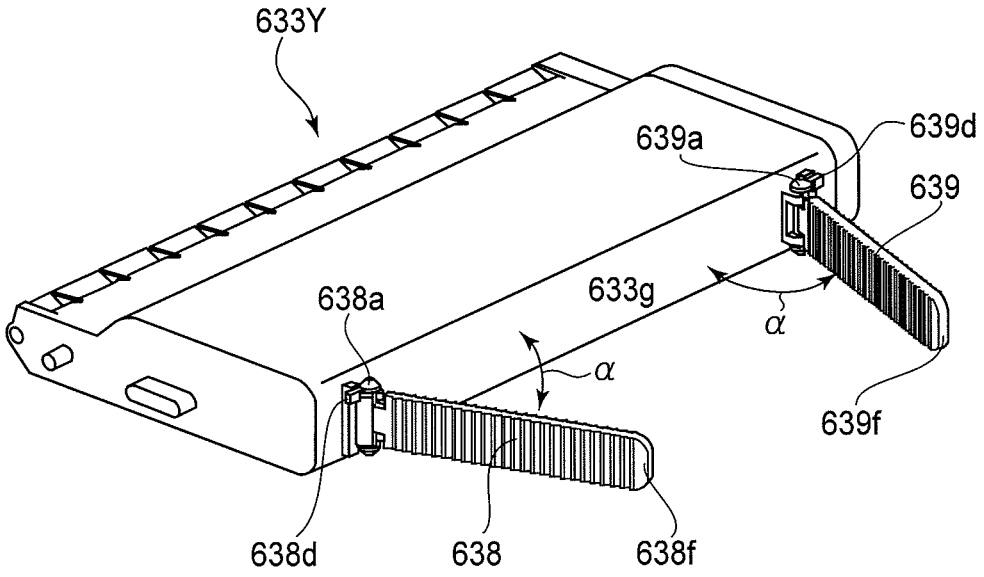

FIG. 20 is a perspective view showing another embodiment of the grip portion.

DESCRIPTION OF THE PREFERRED EMBODIMENTS

The preferred embodiments of the present invention will be described in conjunction with the accompanying-drawings. The dimensions, the materials, the configurations, the relative positions, and so on of the constituent parts which will be described hereinafter may be properly changed by one skilled in the art depending on the structures and the various conditions of a device to which this invention is applied, and the scope of this invention is not limited to specific dimensions, materials, configurations, relative positions and so on of the embodiments which will be described below.

(General Arrangement of Color Electrophotographic Image Forming Apparatus)

Figure 1A:
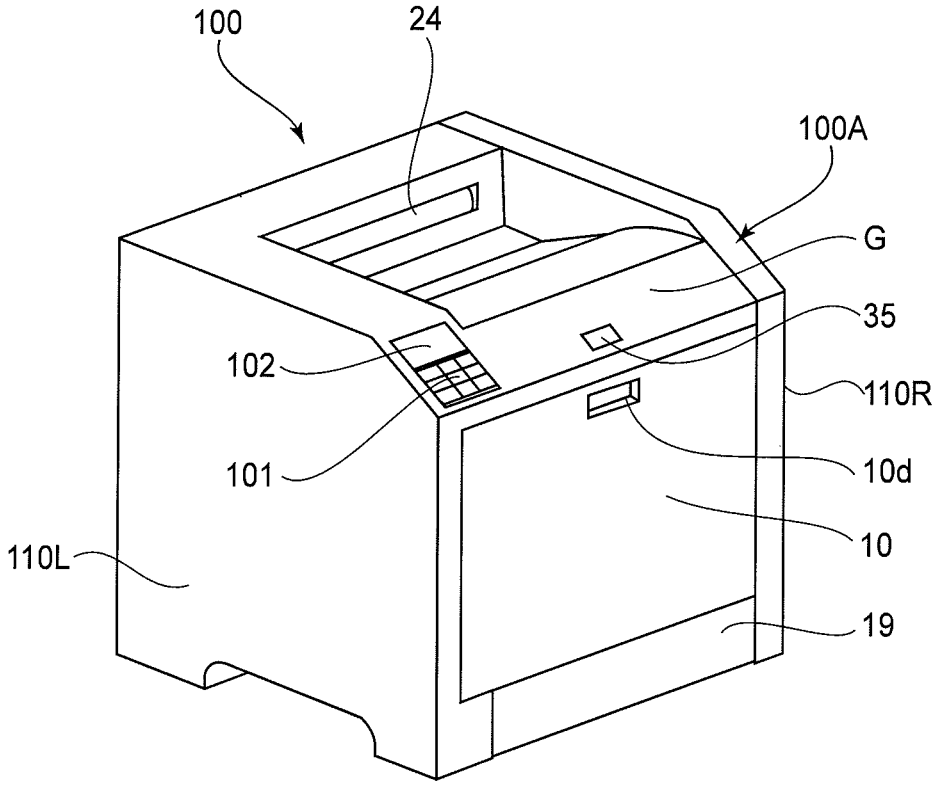
FIG. 1A is an outer appearance perspective view of an image forming apparatus of an embodiment of the present invention.
Figure 1B:
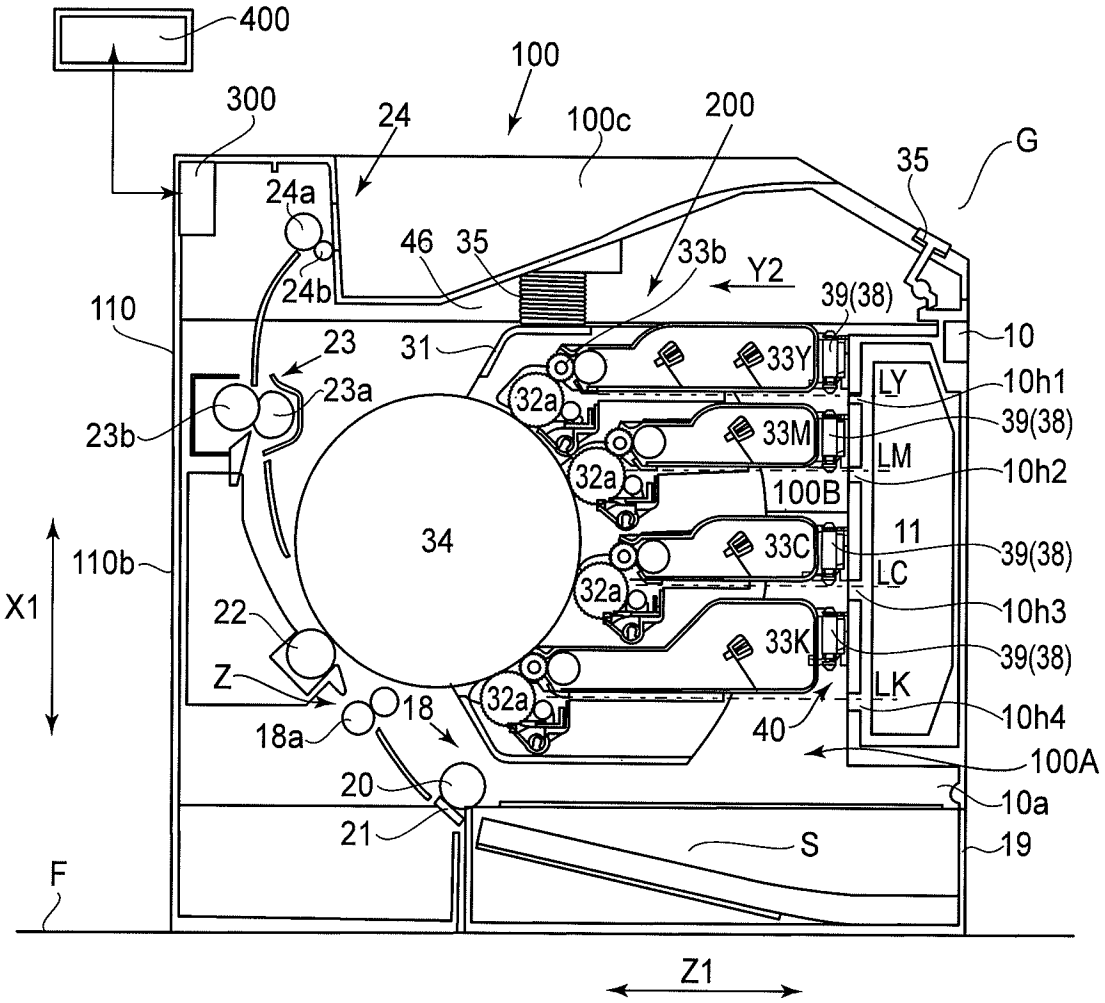
FIG. 1B is a left sectional view of the image forming apparatus.

FIG. 1A is an outer appearance perspective view of an electrophotographic image forming apparatus (image forming apparatus) 100 in this embodiment. FIG. 1B is a left side longitudinal sectional view of the image forming apparatus 100. The image forming apparatus 100 is a laser printer of a full-color (four color) type which uses the electrophotographic process. The image forming apparatus 100 forms a full-color image on a recording material (sheet) S on the basis of the electrical image signal inputted to a control circuit portion 300 from an external host device 400 such as a personal computer, an image reader, a receiving part of a facsimile device.

In the following descriptions, relating to the image forming apparatus 100 a front side is the side in which a feeding cassette 19 for stacking and accommodating recording materials S is drawn out of an inside of an apparatus main assembly 100A to an outside. A backside is the opposite side from it. An upper side is the side in which the recording material S is discharged. Front-rear directions are a direction to the front side from the backside of the image forming apparatus and the reverse direction thereof. The left and right are the left and right, as seen from the front side of the image forming apparatus. The left-right directions are a direction to the left from the right, and the reverse direction thereof. A longitudinal direction is a direction of an axis of an electrophotographic photosensitive drum or a developing roller. The main assembly 100A is portions of the image forming apparatus other than cartridges (units) 33 (33Y, 33M, 33C and 33K). In the image forming apparatus of this embodiment, a right-hand side is a driving side, and a left-hand side is the non-driving side.

Figure 2:
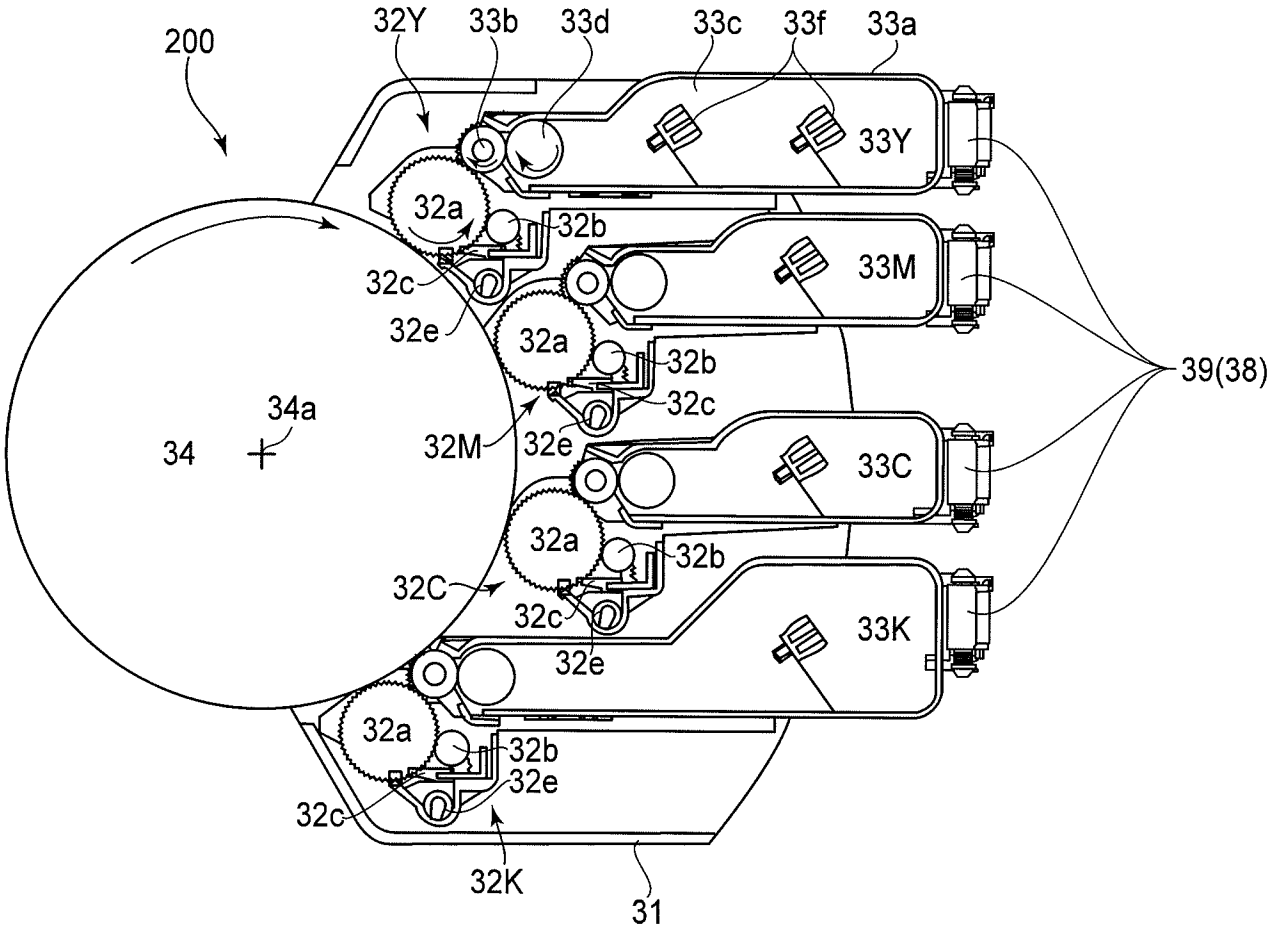
FIG. 2 is an enlarged view of an image forming unit portion.

The image forming apparatus 100 is placed on a substantially horizontal installation surface F such as a mounting base, the desk or the floor. A central portion in the main assembly 100A is provided with the image forming unit 200. FIG. 2 is an enlarged view of the image forming unit 200 shown in FIG. 1B. A unit 200 is provided with the cartridge mounting portion (mounting guide) 321 for dismountably mounting a plurality of cartridges in (present embodiment, the first-fourth developing cartridges 33 (33Y, 33M, 33C and 33K)) and a single intermediary transfer member (transfer member) 34. In this embodiment, an electrophotographic photosensitive drum 32*a* corresponding to the developing cartridge 33 is mounted to the unit 200 as parts of a photosensitive member unit 32 (32Y, 32M, 32C, 32K) with a charging roller 32*b* and a cleaning blade 32*c*. The charging roller 32*b* and the cleaning blade 32*c* are process means. In the image forming apparatus 100, a plurality of cartridges 33 are dismountably mounted to main assembly 100A (unit 200), and a color image is formed on recording material S. The unit 200 will be described in detail hereinafter. In this embodiment, the cartridges 33 have the similar structures, except for the colors of the contained powdery developers (toner). However, they are not limited to this example. For example, a developing cartridge 33K which accommodates a black developer may have a larger capacity developer accommodating portion 33*c* than the developing cartridges 33 which accommodate the developers of the other colors. In this embodiment, the developing cartridge is described as the cartridge but the present invention is not limited thereto. For example, in this embodiment, the drum 32*a*, the charging roller 32*b* and the cleaning blade 32*c* are mounted to the unit 200 but may also be mounted to the developing cartridge 33. In this case, the cartridge is referred to as a process cartridge. This is because the drum 32*a* and the process means including the charging roller 32*b*, the developing roller 33*b* and the cleaning blade 32*c* are integrally assembled into the cartridge, which is detachably mounted in the apparatus main assembly.

(Photosensitive Member Unit)

Each of the units 32 (32Y, 32M, 32C and 32K) is fixed to a sub-frame 31 of the image forming unit 200. Each unit 32 includes the drum 32*a*. The unit 32 includes the charging roller 32*b* and the cleaning blade 32*c* for removing the developer which remained on the surface of the drum 32*a*, as the process means which acts on the drum 32*a*. The feeding screw (feeding member) 32*e* for feeding, in the axial direction of the drum 32*a*, the developer removed by the cleaning blade 32*c* is provided. The drum 32*a*, the charging roller 32*b*, the cleaning blade 32*c*, and the feeding screw 32*e* are disposed with a predetermined arrangement relation relative to a photosensitive member case 32*d*.

Part (a) of FIG. 3 is a perspective view of a unit 32M, as seen from left-hand side. Part (b) of FIG. 3 is a perspective view of a photosensitive member case 32*d* excluding the drum 32*a*, the charging roller 32*b*, and the cleaning blade 32*c* from the unit 32M of (a) of FIG. 3. FIG. 4 is a perspective view of the case 32*d* of (b) of FIG. 3, as seen from a right-hand side. The other units 32Y, 32C and 32K have substantially the same structures, and therefore, the description will be made as to the photosensitive member unit 32M. A right-hand end portion and a left-hand end portion of the case 32*d* are provided with the bearing portions 32*d*1 and 32*d*2 which comprise through-holes, respectively, which support the drum 32*a* rotatably. The insides of the bearing portions 32*d*1 or 32*d*2 are provided with the end sealing members 32*k*1, 32*k*2 contacting the drum 32*a* and the sheet-like sealing members 32*h* extended in the axial direction of the drum 32*a*. The each of the sealing members 32*k*1, 32*k*2 and 32*h* contacts to the surface of the drum 32*a*, so that the developer in the case 32*d* does not leak to an outside. Inside the case 32*d*, a feeding screw 32*e* extended in the longitudinal direction is provided. The right-hand end portion of the screw 32*e* is provided with the feeding gear 32*i*, which receives a driving force from a drum gear 32*a*1 provided at the right-hand end portion of the drum 32*a* through an idler gear 32*j*. A removed developer in the case 32*d* is fed in the direction of the arrow X7 (leftward direction) by rotating operation of the screw 32*e*. The removed developer fed by the screw 32*e* is carried to the removed developer discharging portion 32*f* provided at the left-hand end portion of the screw 32*e*. The removed developer fed by the screw 32*e* is discharged to the outside through an opening (not shown) provided in the discharging portion 32*f*.

The right-hand end portion and the left-hand end portion of each unit 32 is provided with the mounting portion 321 for mounting the cartridge 33, and the mounting portions 321 are extended in the direction perpendicular to the axes of the drums 32*a*, respectively. A part of a mounting portion 321 is provided with a recess 321*a* for receiving the portions-to-be-guided (portions-to-be-regulated) 33*e*1 and 33*e*3 (FIG. 5) of the cartridge 33. Adjacent to the recess 321*a*, there are provided a regulating member 36 for regulating the position of the cartridge 33 and an urging member 37 for urging the regulating.

In this embodiment, the unit 32 is fixed to the unit 200. Therefore, when drum 32*a* or the like is worn, the whole unit 200 is exchanged. However, the unit 32 may be detachably mountable to the unit 200, and in such a case, only the unit 32 is exchanged.

(Cartridge)

As shown in FIG. 2, each of the cartridges 33 (33Y, 33M, 33C and 33K) is provided with a case 33*a* which is a cartridge frame and is provided with the developing roller 33*b* for developing the electrostatic latent image formed on the drum 32*a* into the developer image by supplying the developer to the drum 32*a*. The cartridge 33 is provided with a developer accommodating portion 33*c* which accommodates the developer to be used for the development of the electrostatic latent image and a supplying roller 33*d* for supplying the developer from the developer accommodating portion 33*c* to the developing roller 33*b*. The developer accommodating portion 33*c* is provided with the feeding member 33*f* for feeding the inner developer to the supplying roller 33*d*. A first cartridge 33Y accommodates the yellow (Y) developer in the developer accommodating portion 33*c*, and a Y color developer image is formed on the surface of the corresponding drum 32*a*. A second cartridge 33M accommodates the magenta (M) developer in the developer accommodating portion 33*c*, and a M color developer image is formed on the surface of the corresponding drum 32*a*. A third cartridge 33C accommodates the cyan (C) developer in the developer accommodating portion 33*c*, and a C color developer image is formed on the surface of the corresponding drum 32*a*. A fourth cartridge 33K accommodates the black (K) developer in the developer accommodating portion 33*c*, and a K color developer image is formed on the surface of the corresponding drum 32*a*.

Part (a) of FIG. 5 is a perspective view of the cartridge 33Y, as seen from right-hand side, and (b) is a perspective view of that, as seen from left-hand side. The cartridges 33 will be described as to the case of this cartridge 33Y. The cartridge 33Y is mounted in the direction of the arrow X10 to the mounting portion 321 of the unit 200. The cartridge 33Y is dismounted from the mounting portion 321 of the unit 200 in the direction of the arrow X11 opposite to the arrow X10. The cartridge 33Y is provided with the developing roller 33*b* in a leading end with respect to the mounting direction. The right-hand end portion of the developing roller 33*b* is provided with a gear 50, which receives the driving force from the drum gear 32*a*1 to rotate the developing roller 33*b*. The gear. 50 transmits the driving force to the supplying roller 33*d* and the feeding member 33*f* through a gear train (unshown). The each of the right-hand end portion and the left-hand end portion of the cartridge 33Y is provided with the portions-to-be-guided 33*e*1 and 33*e*3 for being guided by the unit 200, when the cartridge 33Y is mounted to the unit 200. The portions-to-be-guided 33*e*1, 33*e*2, 33*e*3 and 33*e*4 each have a cylindrical shape and project toward the outside of the right-hand end portion and toward the outside of the left-hand end portion of the cartridge 33Y. The portions-to-be-guided 33*e*2 and 33*e*4 each have a substantially rectangular parallelepiped shape, and project toward the outside of the right-end portion and toward the outside of the left-end portion of the cartridge 33Y, and are extended in the direction perpendicular to the longitudinal direction of the cartridge 33. The portions-to-be-guided 33*e*1 and 33*e*2 are located downstream of the portions-to-be-guided 33*e*2 and 33*e*4, respectively, with respect to the mounting direction X10 of the cartridge 33Y. On the cartridge 33Y side opposite from the developing roller (33*b*) side, a first grip (group portion) 38 and a second grip (group portion) 39 for griping the cartridge 33Y are provided on a side wall 33*g*. While griping the first grip 38 and the second grip 39, a user can mount and demount the cartridge 33Y relative to the apparatus main assembly 100A. As has been described in the foregoing, the cartridge 33Y is provided with the first grip 38 and the second grip 39. The other cartridges PM, PC and PK have the same constitution. The constitution of the grip will be described specifically later.

In this embodiment, an intermediary transfer member 34 is rotatable about the substantially horizontal axis of the rotation axis 34*a*, and it is a cylindrical drum. Each cartridge 33 is provided on a front side of the intermediary transfer member 34, and extends substantially parallel with the installation surface F of the main assembly 100A they are provided adjacent to each other with respect to the substantially vertical direction. In the image forming apparatus of this embodiment, the first cartridge 33Y takes a top most stage position, and the second cartridge 33M is placed therebelow. The third cartridge 33C is placed further below. The fourth cartridge 33K takes the bottommost stage position. The developing roller 33*b* of each cartridge 33 may be in contact to the drum 32*a* (contact type developing system) or, it may be spaced with the predetermined small gap (predetermined distance) from the drum 32*a* (non-contact developing system).

(Scanner Unit)

Referring to (b) of FIG. 1, the front part of the front side of each cartridge 33 is provided with a laser scanner unit 11 as an (image) exposure device. The unit 11 includes a laser diode, a polygonal mirror, an Fθ lens, a reflection mirror, and so on. The unit 11 outputs, as information light, laser beams L (LY, LM, LC and LK) which are modulated correspondingly to the image information for the Y, M, C and K color inputted to the control circuit portion 300 from the external host device 400 to scan the drums 32*a* of the cartridges 33 for the corresponding colors (image exposure), so that a latent image is formed on the drums 32*a*. In this embodiment, as the exposure nit, the laser scanner unit using the laser beams but it is also possible to effect the exposure by using an LED, an organic EL device, and the like.

(Recording Material Feeding Mechanism)

A lower part of the unit 200 is provided with a feeding unit 18. The unit 18 includes a feeding cassette 19 for stacking recording material S, a feeding roller 20, a separation pad 21, and so on. The cassette 19 is insertable and extractable in the front side of the main assembly 100A (front loading). In the main assembly 100A, between the transfer member 34 and a rear frame 110*b* of the main assembly 100A, there is provided a recording material feeding path Z extended from the feeding roller 20 to the upper rear portion in the main assembly 100A. A registration roller couple 18*a*, a secondary transfer roller 22, a fixing device 23, and a discharging roller pair 24 is provided along feeding path Z in this order upwardly. The fixing device 23 includes a fixing film unit 23*a* and a pressing roller 23*b*. The discharging roller pair 24 includes a discharging roller 24*a* and a discharging roller 24*b*. An upper surface of the main assembly 100A is provided with a discharging tray 100*c* for receiving a recording material S on which the image has been formed. The cover 10 opens and closes an opening 100B provided in the front surface of the main assembly 100A (opening and closing member). To the cover 10, the laser scanner opening 11 is mounted. As will be described hereinafter, the opening portion 100B for mounting and demounting the cartridge is an opening for mounting and demounting the cartridge 33 relative to the apparatus main assembly 100A. The cover 10 is used for opening and closing the opening portion 100B. By moving the cover 10, which holds the unit 11, to an open position, the cartridge 33 can be mounted and demounted.

FIG. 1B shows the state that the image forming apparatus is capable of image forming operation 100. In this state, the cover 10 is placed in the closed position G for closing the opening portion 100B. The unit 200 is loaded with each cartridge 33, and is placed in an image forming position A for carrying out an image formation relative to the main assembly 100A. A gear (drive inputting portion) 34*b* ((b) FIG. 6) of the transfer member 34 is in engagement with a drive outputting portion (unshown) provided in the main assembly (100A) side. An electric power supply system (unshown) provided in the main assembly (100A) is electrically connected to an electrical contact (unshown) of each unit 32 and cartridge 33. Here, the driving system and the bias voltage application type described above can employ the structure similar to the case of the normal image forming apparatus, although not shown in the Figure for the sake of simplicity.

(Image Forming Operation)

The operation for forming a full-color image will be described. Referring to FIG. 1(*b*) and FIG. 2, each drum 32*a* is rotationally driven in the counter-clockwise direction indicated by the arrow at a predetermined speed. The charging roller 32*b* is rotated by the rotation of the drum 32*a*. The transfer member 34 is rotationally driven at the speed corresponding to the speed of the drum 32*a* in the clockwise direction (codirectional with the rotation of the drum 32*a*) of the arrow. The developing roller 33*b* and the supplying roller 33*d* are rotationally driven at the predetermined speeds in the clockwise directions of the arrows, respectively. The scanner unit 11 also is driven. In synchronism with this drive, a predetermined charging bias voltage is applied to each charging roller 32*b* at predetermined control timing. By this, the surface of each of the drum 32*a* is uniformly charged by the charging roller 32*b* to the predetermined polarity and predetermined potential. The scanner unit 11 scanningly exposes the surface of each drum 32*a* to the laser beams L (LY, LM, LC and LK) modulated in accordance with the corresponding Y, M, C and K image signals. The laser beams L pass through a plurality of exposure windows 10*h*1 to 10*h*4 to reach the surfaces of the drums 32. The exposure windows 10*h*1 to 10*h*4 are provided in the cover 10. The exposure windows 10*h*1 to 10*h*4 are disposed adjacently to each other in the X1 direction in which the respective cartridges 33 are also disposed adjacently to each other. Incidentally, the exposure windows 10*h*1 to 10*h*4 extend in a direction perpendicular to the X1 direction, i.e., in a longitudinal direction of the drum 32*a* ((a) and (b) of FIG. 7). The exposure windows 10*h*1 to 10*h*4 which are a minimum necessary member for the exposure are provided between the scanner unit 11 and the cartridges 33, so that it is possible to minimize entering of dust into the scanner unit 11. By this, the electrostatic latent image corresponding to the correspondence color image signals is formed on the surface of the drum 32*a* of each cartridge 33. The electrostatic latent image formed on the surface of each drum 32*a* is developed into the developer image by the developing roller 33*b* of the corresponding cartridge 33. The developing roller 33*b* is supplied with a predetermined developing bias voltage at the predetermined controlled timing. Through the above-described electrophotographic image forming process operation, a Y color developer image corresponding to a yellow component of the full-color image is formed on the drum 32*a* opposed by a cartridge 33Y. The developer image is transferred (primary transfer) onto the transfer member 34 in a primary transfer nip which is the contact portion between the drum 32*a* and the intermediary transfer member 34. An M color developer image corresponding to a magenta component of the full-color image is formed on the drum 32*a* opposed by a cartridge 33M. The developer image is transferred (primary transfer) onto the transfer member 34 in a primary transfer nip which is the contact portion between the drum 32*a* and the transfer member 34 superimposedly on the already transferred Y color developer image. A C color developer image corresponding to a cyan component of the full-color image is formed on the drum 32*a* opposed by a cartridge 33C. The developer image is transferred (primary transfer) onto the transfer member 34 in the primary transfer nip which is the contact portion between the drum 32*a* and the transfer member 34 superimposedly on the already transferred Y color+M color developer image. A K color developer image corresponding to a black component of the full-color image is formed on the drum 32*a* which the cartridge 33K opposed. The developer image is transferred (primary transfer) onto the transfer member 34 in the primary transfer nip which is the contact portion between the drum 32*a* and the transfer member 34 superimposedly on the already transferred Y color+M color+C color developer images. In this way, a full-color developer image of the Y color+M color+C color+K color is synthetically formed on the transfer member 34. An order of the colors of the developer images transferred is not limited to the above described order. In each of the untransferred developer remaining on the drum surface after the primary transfer of the developer image relative to the transfer member 34 is removed by the cleaning blade 32*c*. The removed developer is fed to residual developer container (not shown), provided at a longitudinal end portion, through the feeding screw 32*e*.

On the other hand, the feeding roller 20 is driven at the predetermined controlled timing. In this manner, by a cooperation of the feeding roller 20 and the separation pad 21, the separation and feeding of the sheet-like recording materials S stacked in the cassette 19 is carried out one by one. The recording material S is introduced into the secondary transfer nip which is the contact portion between the transfer member 34 and the secondary transfer roller 22, at the predetermined controlled timing by the registration roller couple 18*a*. The transfer roller 22 is supplied with the secondary transfer bias voltage of the predetermined potential having the polarity opposite to that of the charge polarity of the developer at the predetermined controlled timing. By this, while the recording material S is nipped and fed by the transfer nip, the developer image on the intermediary transfer member 34 on which it is superimposed is sequentially transferred (secondary transfer) onto the surface of recording material S. The recording material S which has passed through the secondary transfer nip is separated from the surface of the transfer member 34 and it is introduced to the fixing device 23, where it is heated and pressed by a fixing nip. By this, the color developer images are mixed and fixed on recording material S. The recording material S is discharged out of the fixing device 23, and is discharged on the cover 10 which functions as a discharging tray by discharging roller pair 24 as a full-color print. The toner remaining after the secondary transfer remaining on the surface of the transfer member 34 after the separation of the recording material S from the transfer member 34 is removed. In the case of this embodiment, the toner is electrostatically deposited onto the surface of the drum 32*a* in the primary transfer nip 34*b* in the unit 32Y between the drum 32*a* and the transfer member 34, and, and then it is removed by the cleaning blade 32*c*.

The transfer member 34 is the rotatable member of a drum configuration. The different color developer images formed on the drums 32*a* is superimposedly transferred onto the transfer member 34. The developer images transferred superimposedly is transferred all together onto the recording material S from the transfer member 34. By this, the color image is formed on the recording material S. In the case where a monochromatic image is to be formed, the color developer image K formed on the drum 32*a* to which the cartridge 33K is opposed is transferred onto the transfer member 34. The transferred black developer image is transferred onto recording material S from the transfer member 34. By which a K color image is formed on the recording material S. In this embodiment, the secondary transfer roller 22 is movable between a first position in which it contacts to the transfer member 34 and forms the secondary transfer nip and a second position spaced from the transfer member 34 by a shifting mechanism (unshown). At the time of an image forming operation of the image forming apparatus 100, the secondary transfer roller 22 is moved to the first position, and at the time of then on-image formation, it is moved to the second position. The transfer roller 22 may normally be contacted with the intermediary transfer member 34.

(Image Forming Unit)

Referring to (a) and (b) of FIG. 6, the structure of the unit 200 will be described. Part (a) of FIG. 6 is a perspective view of the unit 200, as seen from left-hand side, and (b) is a perspective view, as seen from right-hand side. The unit 200 is provided with a sub-frame 31 detachably mountable relative to the main frame 110 of the main assembly 100A. The frame 31 supports the transfer member 34 which includes a cylindrical base member and an elastic member which coats the peripheral surface thereof rotatably. The transfer member 34 is rotatably supported at the left-hand end portion and the right-hand end portion of the center shaft (rotation shaft) 34*a* between a left side plate 31L and a right side plate 31R of the frame 31. A left shaft portion 45L and a right shaft portion 45R are fixed integrally to the outer surface of the side plates 31L, 31R co-axially with the center axis 34*a* of the transfer member 34. The right-hand end portion of the transfer member 34 is provided with a gear 34*b* which transmits the driving forces to the drums 32*a* to transmit the driving force transmitted from a main assembly driving source (unshown) to the drum gears 32*a*1. About the transfer member 34, the photosensitive member units 32 32Y, (32M, 32C and 32K) are disposed, so that the drums 32*a* are contacted to the transfer member 34. Each of the unit 32 is positioned relative to the frame 31 by a positioning structure (unshown), and is fixed by screws or the like thereto. By this, the drum 32*a* and the transfer member 34 of each unit 32 can be positioned relative to each other with, high precision. Each drum 32*a* is in contact to the transfer member 34 with a predetermined urging force. Each unit 32 is inserted and fixed in the direction of the arrow X1 relative to the frame 31. The right side plate 31R of the frame 31 is provided with the portion-to-be-regulated 311 for regulating a rotation of the unit 200 in the main assembly 100A. The unit 200 is positioned in the main assembly 100A by the left shaft portion 45L, the right shaft portion 45R, and the portion-to-be-regulated 311. The details thereof will be described hereinafter. The left shaft portion 45L, the right shaft portion 45R, and a portion-to-be-regulated-in-rotation 311, which are the positioning portions for the transfer member 34 in the main assembly 100A is commonly provided on the frame 31. By this, the position of the transfer member 34 in the main assembly 100A is determined with high precision. As has been described in the foregoing, there are provided cartridge mounting portions 321 for dismountably carrying out to mounting of the cartridge 33 to the unit photosensitive member 32 fixed to the frame 31. The function of the mounting portions 321 will be described later.

(Image Forming Unit Mounting Portion)

As shown in (a) and (b) of FIG. 7, a left-hand side guiding plate 80L and a right-hand side guiding plate 80R is provided opposed to the inside of a left-hand side frame 110L of the main assembly 100A and the inside of a right-hand side frame 110R fixedly. The each of the guiding plates 80L and 80R is provided with a positioning portion 80*a* for supporting the left and right shaft portions 45L and 45R of the frame 31 rotatably and a guide portion 80*b* for guiding the shaft portions 45L and 45R to the positioning portion 80*a*. The guiding plate 80R is provided with a rotation regulating portion 80*c* which is continuous with the guide portion 80*b*. The portion-to-be-regulated-in-rotation 311 provided on the unit 200 contacts to the guiding plate 80R to limit the rotation of the unit 200.

(Mounting of the Image Forming Unit)

The description will be made as to the mounting of the unit 200 into the main assembly 100A. A lower end side of the cover 10 is rotatably coupled through a hinge shaft 10*a* to the main assembly 100A, and it is movable between the closing position G (FIG. 1B) for closing a side opening 100B of the main assembly 100A and the open position H ((a) of FIG. 7) for opening the opening 100B. The cover 10 is an opening and closing member which is rotatable for opening and closing the opening 100B in the side portion of the main assembly 100A about the hinge shaft 10*a*. The closed state (closing position) of the cover 10 is maintained by the engagement (latch engagement) between a locking claw portion 35*a* provided on a maintenance button (35) provided on a front side of the main assembly 100A and the locking claw portion 10*b* provided on the cover 10, as shown in (a) of FIG. 8. The locking claw portion 35*a* is the main assembly side locking portion, and the locking claw portion 10*b* is an opening and closing member side locking portion. The closure releasing of the cover 10 is carried out by the user pushing a button 35. When the user pushes a button 36 rearwardly against the spring (unshown), the locking claw portion 35*a* on the button (35) side disengages from the locking claw portion 10*b* on cover (10) side backwardly to release the latch engagement, as indicated by chain lines. By this, the cover 10 is rotated to the open position H about the hinge shaft 10*a* to open the opening portion 100B greatly. In this embodiment, the locking claw portion 36*a* and the locking claw portion 10*b* are elastically locked with each other releasably. However, this embodiment is not limited to this example. For example, the claw (locking portion) provided on one side maybe elastically and releasably locked with the hole (locking portion) provided in another side.

As shown in FIG. 9A, for the mounting of the unit 200 into the main assembly 100A, the user rotates the cover 10 to the open position H to greatly open the opening portion 100B. The user inserts the unit 200 into the main assembly 100A from the opening portion 100B. The left and right shaft portions 45L, 45R of the unit 200 is engaged with the guide portions 80*b* opposed to the guiding plates 80L and 80R of the main assembly (100A), and the unit 200 is mounted into the main assembly 100A. In this manner, the unit 200 is mounted into the main assembly 100A. Thereafter, the shaft portions 45L, 45R are contacted to the positioning portion 80*a* provided on an extension of the guide portion 80*b* (FIG. 9B). At this time, the gear 34*b* (FIG. 6) provided at the one-end portion of the transfer member 34 engages with a driving gear (unshown) provided in the main assembly 100A. Thereafter, the cover 10 is rotated to the closing position G to complete the mounting of the unit 200 into the main assembly 100A.

(Mounting of the Cartridge)

The mounting and demounting of each cartridges 33 (33Y, 33M, 33C, 33K) relative to the unit 200 is carried out in the state that the unit 200 will be described with reference to FIGS. 10A and 10B. First, the cover 10 is moved to the open position which opens the opening portion 100B from the closing position which closes the opening portion 100B.

Then, the user grips the first grip 38 and the second grip 39 (FIG. 5) provided on the side wall 33*g* of the cartridges 33 (33Y, 33M, 33C and 33K). Each cartridge 33 is mounted to the corresponding mounting portion 321 of the unit 200. The mounting direction is the direction (mounting direction) perpendicular to a rotational axis direction of a developing roller 33*b*.

In more detail, as shown in FIG. 10A, the portions-to-be-guided 33*e*1 (unshown) and 33*e*3 of the right-hand side and left-hand side of the cartridge 33, are inserted into the mounting portion 321 of the right-hand side and left-hand side provided in the unit 200, respectively. FIG. 10A shows the case of the mounting of the cartridge 33Y which is inserted into the mounting portion 321. Subsequently, the portions-to-be-guided 33*e*2 (unshown) and 33*e*4 are inserted. The portions-to-be-guided 33*e*1-33*e*4 are guided by the mounting portion 321, and are inserted into the inside toward the drum 32*a*. The portions-to-be-guided 33*e*1 and 33*e*3 are abutted to the regulating member 36 provided in the mounting portion 321. The regulating member 36 in this embodiment is an L-shape member, and the portions-to-be-guided 33*e*1 and 33*e*3 are abutted to the L-shape portion. In the free state of the regulating member 36, the regulating member 36 is raised by the urging force of the urging member 37, so that an L-shape portion enters the recess 321*a* of the mounting portion 321, and abuts to and is stopped by the upper surface 321*a* of the ceiling surface. Furthermore, when the cartridge 33 is further inserted, the portions-to-be-guided 33*e*1 and 33*e*3 pushes the L-shape portion of the regulating member 36 down against the urging force of the urging member 37 which urges the regulating member 36. By this, the regulating member 36 is pushed down in the direction of an arrow X5 away from the recess 321*a* of the mounting portion 321, so that the portions-to-be-guided 33*e*1 and 33*e*3 enter between the top surface of the regulating member 36 and the ceiling surface of the recess 321*a*. As a result, the portions-to-be-guided 33*e*1 and 33*e*3 ride over the regulating mount 36 to enter a rear side in the recess 321*a*. Further, the portion-to-be-guided 33*e*2 and 33*e*4 also enter the recess 321*a* of the mounting portion 321. Thus, the mounting of the cartridge 33 in the unit 200 is completed.

The cover 10 includes the cartridge using members 51*a* to 51*d* for urging the cartridges 33 toward the photosensitive member unit 32 (FIG. 10B). The cartridge urging members 51*a* to 51*d* are provided at end portions with respect to the longitudinal direction (left-right direction) of the cartridges 33. Two cartridge urging members are provided for each cartridge 33. The urging members 51*a* to 51*d* are successively contacted to the rear end portions of the cartridges 33 in interrelation with the closing operation of the cover 10. As shown in FIG. 1B, when the unit 200 is located at the image forming position, the cartridges 33 are urged in the direction of an arrow Y2 of the urging members 51*a* to 51*d*. The developing roller 33*b* accommodated in the cartridge 33 is contacted to the drum 32*a* with a certain urging force by contacting regulating rollers (unshown) provided at its end portions to the drum 32*a*. The urging force by the urging members 51*a* to 51*d* satisfactorily maintains a contact state between the developing roller 33*b* and the drum 32*a*.

Also with respect to the first grip 38 and the second grip 39, the cover 10 partly contacts the first grip 38 and the second grip 39 in interrelation with the closing operation of the cover 10, so that the first grip 38 and the second grip 39 are rotated from the projected position (FIG. 10B) to the retracted position (FIG. 1B). This will be described later in detail.

By the above-described operation, the image forming apparatus 100 becomes in the state that an image forming operation (print operation) can be carried out, and the image forming operation described above is carried out on the basis of an image formation start signal (print start signal). The drive outputting portion (unshown) of the main assembly (100A) side is coupled with the gear 34*b* of the drive inputting portion of the intermediary transfer member 34 of the unit 200 located at the image forming position A. The drum gear 32*a*1 of each photosensitive member unit 32 couples with the gear 34*b*. The gear 50 of the developing roller 33*b* couples with it. The electric power supply system of the main assembly side is electrically connected to the electrical contacts of the photosensitive member units 32 and the cartridges 33. By this, the image forming apparatus 100 is capable of carrying out the image forming operation.

In the image forming apparatus 100 in this embodiment, the scanner unit 11, the cartridge 33, the drum 32*a*, the transfer member 34, and the feeding path Z for the recording material S are disposed substantially in parallel with the installation surface F, as shown in FIG. 1B. In the upper portion of the image forming apparatus 100, the discharging tray 100*c* is provided, and the cassette 19 is disposed at the lower portion of the image forming apparatus 100. The laser beams L (LY, LM, LC, LK) are projected from the unit 11 to the drum 32*a* in the rear part of the cartridge 33 through the exposure windows 10*h*1 to 10*h*4. The color developer image transferred onto the transfer member 34 from each drum 32*a* is transferred onto recording material S in the opposite side from each drum 32*a* with respect to the transfer member 34.

(General Structure of Grip of Cartridge)

The first grip (grip portion) 38 and the second grip (grip portion) 39 provided to each of the cartridges 33 (33Y, 33M, 33C, 33K) will be described more specifically with reference to FIGS. 11 to 13. The description will be made as to the cartridge 33Y but other cartridges 33M, 33C and 33K have the same constitution as that of the cartridge 33Y.

On the side wall 33*g* of the case 33*a* of each cartridge 33, the first grip 38 and the second grip 39 are disposed. The first grip 38 and the second grip 39 includes rotational shafts 38*a* and 39*a* at longitudinal end portions of the side wall 33*g*, and the rotational shafts 38*a* and 39*a* are rotatably mounted to mounting portions 33*g*1 and 33*g*2 provided on the side wall 33*g*. The mounting portions 33*g*1 and 33*g*2 have a semicircular shape so as to permit rotation of the rotational shafts 38*a* and 39*a*. Entrance portions 33*g*3 and 33*g*4 of the mounting portions 33*g*1 and 33*g*2 have a snap-fit shape and when the rotational shafts 38*a* and 39*a* are pressed into the entrance portions 33*g*3 and 33*g*4, the entrance portions 33*g*3 and 33*g*4 are elastically deformed. When the rotational shafts 38*a* and 39*a* are completely accommodated in the mounting portions 33*g*1 and 33*g*2, the elastically deformed entrance portions 33*g*3 and 33*g*4 are returned to the original states, so that the rotational shafts 38*a* and 39*a* are prevented from being easily disconnected.

Further, at vertical end portions of the rotational shaft 38*a*, head portions 38*b* and 38*c* which are larger in diameter than the portion accommodated in the mounting portion 33*g*1 are provided, thus functioning as a retaining portion for the rotational shaft 38*a* of the first grip 38 with respect to an axial direction. Similarly, the rotational shaft 39*a* is provided with head portions 39*b* and 39*c*.

In this embodiment, the rotational shafts 38*a* and 39*a* are mounted to the semicircular mounting portions 33*g*1 and 33*g*2 but it is also possible to employ a constitution in which the rotational shafts 38*a* and 39*a* have the semicircular shape and the mounting portions 33*g*1 and 33*g*2 have a shaft shape. That is, a projection/recess relationship may also be reversed so long as the rotational shaft and the mounting portion can be engaged with each other and the grip is rotatable about the mounting portion.

As described above, the first grip 38 and the second grip 39 are configured to be rotatable (movable) about the rotational shafts 38*a* and 39*a* in the directions of arrows Z1 and Z2, respectively. Part (a) of FIG. 12 is a top plan view showing a state in which the first grip 38 and the second grip 39 which have been rotated are located at the projected position extended in cartridge demounting direction crossing the longitudinal direction of the cartridge. The first grip 38 and the second grip 39 are configured to be rotatable between the projected position in which the grips are projected from the side wall 33*g* of the cartridge 33 as shown in (a) in FIG. 12 and the retracted position in which the grips are close to the side wall 33*g* of the cartridge 33 than the projected position as shown (b) of FIG. 12.

The user performs the mounting and demounting operation while gripping the first grip 38 and the second grip 39 in a state in which the first grip 38 and the second grip 39 are located at the projected position as shown in (a) and (b) of FIG. 11.

The side wall 33*g* has a shape such that it is elongated in the longitudinal direction. The longitudinal direction in this embodiment is the same as the longitudinal direction of the developing roller 33*b*. Further, the side wall 33*g* of a portion of the case 33 of the cartridge 33 and is located on an upstream side with respect to the demounting direction of the cartridge 33 from the apparatus main assembly 100A.

The first grip 38 and the second grip 39 are rotatable (arrows Z1, Z2) about the rotational shafts 38*a* and 39*a* so as to be retracted toward the side wall 33*g* with respect to the longitudinal direction. The rotational shafts 38*a* and 39*a* are configured so that a phantom extension line (rotational axis line) L7 of the rotational shaft extends in the vertical direction. However, the rotational shafts 38*a* and 39*a* may also be somewhat tilted.

As shown in (a) in FIG. 11, an amount (distance) of projection of each of the first grip 38 and the second grip 39 from the side wall 33*g* when the first grip 38 and the second grip 39 are located at the projected position is taken as X. Further, when a length (height) of the side wall 33*g* with respect to a widthwise direction perpendicular to the longitudinal direction of the side wall 33*g* is taken as Y ((a) of FIG. 11), a relationship of X>Y is satisfied. Therefore, the user can easily grip the cartridge 33, so that the cartridge 33 is excellent in ease of handling. Thus, by employing the constitution in which the first grip 38 and the second grip 39 are rotated with respect to the longitudinal direction of the side wall 33*g*, the large projection amount X can be ensured and the grips 38 and 39 can be retracted at the retracted position to save space. As a result, it is possible to not only improve ease of handling of the cartridge by the user but also bring the member of the apparatus main assembly near to the cartridge, with the result that the apparatus main assembly can be downsized.

FIG. 13 is a schematic view of the cartridge 33 viewed from the demounting direction of the cartridge 33 when the first grip 38 and the second grip 39 are located at the retracted position. The first grip 38 and the second grip 39 are close to the outer surface of the cartridge 33. Therefore, with respect to the widthwise direction, the downsizing of the cartridge 33 can be achieved. Further, the member of the apparatus main assembly or the adjacent cartridge can be brought near to the cartridge 33, so that the apparatus main assembly can also be downsized.

The first grip 38 and the second grip 39 are provided at the end portions of the side wall 33*g* with respect to the longitudinal direction and are configured to be rotatable toward an inside portion between the end portions. Therefore, the user can grip the cartridge 33 with both hands, so that the user can stably mount and demount the cartridge relative to the apparatus main assembly.

However, at the sacrifice of some extent of stability, as shown in (a) of FIG. 14, only one guide 138 rotatable (arrow Z1) with respect to the longitudinal direction may be provided at a longitudinal central portion. As a results, the number of parts used for the grips can be reduced. Further, as shown in (b) of FIG. 14, a first grip 238 and a second grip 239 are provided at the longitudinal central portion, so that the guides 238 and 239 can be rotated (arrows Z1, Z2) toward the longitudinal end portions. In either case, the ease of handling of the cartridge by the user is excellent and the downsizing of the apparatus main assembly can also be achieved similarly as in the above-described embodiments.

(Rotation Preventing Constitution for Grip)

A rotation-preventing constitution for the first grip 38 and the second grip 39 when the first grip 38 and the second grip 39 are located at the projected position will be described. The description will be made as the first grip 38 but the same constitution is applied to the second grip 39.

As shown in (b) in FIG. 11, a portion-to-be-prevented 38*d* outwardly extending in the radial direction of the rotational shaft 38*a* is provided near the head portion 38*b* of the first grip 38. The portion-to-be-prevented 38*d* contacts a rotation-preventing portion 33*h* provided at a part of the cartridge 33 when the first grip 38 is rotated from the retracted position to the projected position. Therefore, the first grip 38 is prevented from rotating about the rotational shaft 38*a* to the outside of the cartridge 33 with respect to the longitudinal direction while riding over the preventing portion 33*h*. That is, the preventing portion 33*h* prevent the first grip 38 and the second grip 39 from rotating from the projected position toward a direction opposite from the direction of the retracted position.

Thus, by using the portion-to-be-prevented 38*d* and the preventing portion 33*h* to regulate the rotation position of the first grip 38, the user can stably grip the cartridge 33 when the user grips the first grip 38. In the case where if there are no portion-to-be-prevented 38*d* and preventing portion 33*h*, the first grip 38 is rotated about the rotational shaft 38*a* toward the outside of the cartridge 33 with respect to the longitudinal direction and therefore stability is poor when the user grips the cartridge 33.

(Grip-Locking Constitution)

A grip-locking constitution will be described when the first grip 38 and the second grip 39 are located at the projected position. The description will be made as to the first grip 38 but the same constitution is applied to the second grip 39.

Part (a) of FIG. 15 is a sectional view of the cartridge taken along S-S line indicated in (b) of FIG. 11. The portion-to-be-prevented 38*d* of the first grip 38 is provided with a large-diameter portion 38*d*1 and a small-diameter portion 38*d*2 as shown in (a) of FIG. 15. When the first grip 38 is rotated from the retracted position to the projected position, a locking portion 33*i* provided to the cartridge 33 is inserted into the small-diameter portion 38*d*2 provided to the first grip 38. Finally, a portion-to-be-locked 38*d*3 for connecting the large-diameter portion 38*d*1 and the small-diameter portion 38*d*2 is locked by an end of the locking portion 33*i*.

The locking portion 33*i* has a snap-fit structure (having a gap g for permitting deformation at a vertically central portion), so that the portion-to-be-locked 38*d*3 is locked by the locking portion 33*i*. Therefore, the first grip 38 is locked at the projected position and is not easily returned to the retracted position.

When the first grip 38 and the second grip 39 are rotated from the projected position to the retracted position, the portion-to-be-locked 38*d*3 is disconnected from the locking portion 33*i* against an elastic force of the snap fit to release the locking.

However, during ordinary handling, i.e., when the cartridge 33 is handled by using the first grip 38 and the second grip 39, the portion-to-be-locked 38*d*3 is configured so as not to be disconnected from the locking portion 33*i*.

Thus, each of the first grip 38 and the second grip 39 includes the portion-to-be-locked 38*d*3, which is locked at the projected position by being engaged with the locking portion 33*i* provided to the cartridge 33. Therefore, when the user grips the first grip 38 and the second grip 39, the grips 38 and 39 are not easily returned to the retracted position, so that the user can easily grip the cartridge 33.

In addition to the constitution described above, as shown in (b) of FIG. 15, a friction member 49 may be provided between a retracted position 338*a* of a first grip 338 and a mounting portion 333*g*1. The friction member 49 generates a frictional force against a force for rotating the first grip 338 from the projected position toward the retracted position. For this reason, when the user grips the first grip 338 and a second grip 339 (unshown) similarly as in the above case, the grips 338 and 339 are not easily returned to the retracted position. Incidentally, in the constitution shown in (b) of FIG. 15, the friction member 49 is interposed between the rotational shaft 338*a* and the mounting portion 333*g*1 but may also be provided at any position of a cartridge 333 so long as the friction member can generate the frictional force in contact with the first grip 338.

(Grip-Supporting Constitution)

A grip-supporting constitution when the first grip 38 and the second grip 39 are located at the projected position will be described. The description will be made as to the first grip 38 but the same constitution is applied to the second grip 39.

As shown in (a) of FIG. 15, the portion-to-be-locked 38*d*3 also functions as a supporting portion for supporting the weight of the cartridge 33 when the user grips the first grip 38, while locking the first grip 38. On the other hand, the locking portion 33*i* also functions as a portion-to-be-supported.

That is, when the user grips the first grip 38, the cartridge 33 is moved toward the gravitational direction by its own weight. However, the weight of the cartridge 33 can be supported by the portion-to-be-locked 38*d*3 provided to the first grip 38, so that the user can stably grip the cartridge 33.

In addition to the above constitution, as shown in FIG. 16, a supporting portion 438*e* may be provided below a first grip 438 with respect to the vertical direction. In this case, a portion-to-be-supported 433*h* provided to a cartridge 433 has the function of being supported by the supporting portion 438*e*. The supporting portion 438*e* has an elongated flat surface at which the weight of the cartridge 433 is supported. In addition, the rotation of the first grip 438 is prevented by using a portion-to-be-prevented 438*d* or the like. Also in this constitution, the ease of handling of the cartridge by the user is excellent similarly as in the above-described constitutions.

FIG. 1B is a sectional view of the image forming apparatus 100 when the first grip 38 and the second grip 39 are located at the retracted position. The first grip 38 and the second grip 39 are configured to be rotated with respect to the longitudinal direction of the side wall 33*g*, so that an optical path of the laser beam L (LY, LM, LC, LK) is not adversely affected. That is, there is no possibility that the laser beam is blocked by the grip located at the retracted position and fails to properly reach the drum 32*a*. In the case where a plurality of drums 32*a* are disposed adjacently to each other as in this embodiment, there is a need to emit the laser beam L corresponding to each of the drums 32*a*. Therefore, the constitution in this embodiment is more effective.

(Exchange of Cartridge)

In each cartridge 33 (33Y, 33M, 33C, 33K), the developer contained in the developer accommodating portion 33*c* of the cartridge 33 is consumed, as it is used for the image formation. Means (unshown) for detecting a developer remainder of each cartridge 33 is provided, and the control circuit portion 300 compares a detected remaining amount value with the threshold for the lifetime fore notice and a lifetime warning of a cartridge set beforehand. For the cartridge 33 with which the detected remaining amount value is lower than the threshold, a lifetime forenotice or the lifetime warning of the cartridge 33 is displayed on a display portion 102 (FIG. 1A) provided in an operating portion 101 of the image forming apparatus 100. Or, the lifetime forenotice or the lifetime warning about the cartridge 33 thereof is displayed on the display portion (unshown) of the external host device 400. By this, a preparation of the cartridge for the exchange is prompted, or, the exchange of the cartridge is prompted for the user. Also with respect to the container (unshown), it is detected that the residual developer more than the predetermined level is contained in the container, and the event is displayed on the display portion 102 and so on to prompt the user to the exchange of the container 40.

In the image forming apparatus 100 of this embodiment, the exchange of each cartridge 33 mounted to the unit 200 and the exchange of the container are carried out by opening the top opening 100B of the main assembly 100A by opening the cover 10 shown in FIG. 1A. As shown in FIG. 1B, the releasing of the closure of the cover 10 locked to the closing position G is effected by pushing a maintenance button 35 provided on the front side of the main assembly 100A as indicated by the chain line of (a) of FIG. 8. When the user pushes the button 35 rearwardly against the spring (unshown), the button (35) side locking claw portion 36*a* escapes from the cover (10) side locking claw portion 10*b* rearwardly as indicated by the chain line of (a) of FIG. 8 to release the latch engagement. In this manner, the cover 10 is moved downward by its own weight. The cover 10 is rotated in an open direction from the main assembly 100A by an angle corresponding to an operation distance (restoration length to a free length) of the urging members 51*a* to 51*d* ((a) of FIG. 7) about the hinge shaft 10*a* (FIG. 1A). More particularly, the cover 10 becomes partly open state automatically by the elastic forces of the urging members 51*a* to 51*d*. However, at this time, the center of gravity of the unit 11 is located toward the apparatus main assembly 100A side more than the center of the hinge shaft 10*a*, so that the cover 10 is not rotated downward by the action of the gravitation. Part (b) of FIG. 8 shows the partly open state of the cover 10. Thereafter, when the user lifts the finger from the button 35, the force (elastic force) of the urging spring (unshown) restores it to the previous position. At this time, the locking claw portion 10*b* is at a side portion by the partially open movement of the cover 10. Therefore, it does not engage with the restored locking claw portion 35*a* ((b) of FIG. 8). The user places a fingers on a grip portion 10*d* of the cover 10 in the partly open state, and opens the cover 10 by a manual operation to the open position H, as shown in (b) of FIG. 9. The cover 10 is sufficiently opened to the open position H it and contacts a part of the apparatus main assembly or a surface of a desk, thus being maintained stably. As a result, the opening portion 100B is sufficiently opened greatly. In this state, the cartridge 33 and the container are demounted in the reverse of the mounting operation described above.

(Rotation Constitution of Grip to Projected Position)

When the user opens the cover 10 to expose the opening portion 100B of the apparatus main assembly 100A, the first grip 38 and the second grip 39 are automatically rotated to the projected position. The description will be made as to the first grip 38 but the same constitution is applied to the second grip 39.

As shown in (b) of FIG. 11, a torsion coil spring 52 is provided between the first grip 38 and the cartridge 33. An end portion 52*a* of the torsion coil spring 52 contacts a groove 331 and the other end portion (unshown) contacts a portion-to-be-urged 38*e* provided to the first grip 38. The first grip 38 can be rotated automatically to the projected position from the retracted position close to the side wall 33*g* by an urging force of the torsion coil spring (urging member) 52. The coil spring 52 urges the first grip 38 from the retracted position toward the projected position. When the first grip 38 is located at the retracted position, the first grip 38 approaches the side wall 33*g* against the urging force of the coil spring 52.

In addition to the above constitution, as shown in FIG. 17, in a state in which the cartridge 33 is mounted in the apparatus main assembly 100A, an axial line L1 of a rotational shaft 538*a* can be tilted with respect to a vertical line L2. That is, a head portion 538*a*1 which is an upper side of the rotational shaft 538*a* is tilted in the projected position direction (indicated by an arrow X). Thus, the gravitational direction J1 generated at the center of gravity J of the first grip 538 crosses the axial line L1. Therefore, by the action of the gravitation, a force for rotating the first grip 538 about the rotational shaft 538*a* in the projected position is generated, so that the first grip 538 can be rotated automatically to the projected position.

A tilting amount of the first grip 538 may be determined in view of the weight of the first grip 38 and a frictional force or the like between the first grip 538 and the mounting portion 533*g*1. The first grip 538 can rotate automatically to the projected position, at which it is projected from the side wall 533*g*, by its own weight. In this constitution, there is no need to use the urging member or the like, so that the first grip 438 can be automatically rotated to the projected position inexpensively.

As described above, such a constitution that the first grip 38 (538) and the second grip 39 (539) can automatically rotate to the projected position is employed, so that the user can easily grip the first grip 38 (538) and the second grip 38 (539).

However, when the ease of handling is sacrificed to some extent, the user may rotate the first grip 38 and the second grip 39 from the projected position with his (her) hands without the automatic rotation.

(Moving Constitution of Grip to Retracted Position)

An operation of the grip when the cover 10 is closed will be described.

FIG. 10B is a sectional side view of the image forming apparatus when the first grip 38 and the second grip 39 are located at the projected position. In this state, the user performs the mounting and demounting operation of the cartridge 33.

At this time, in the state in which the cover 10 is opened, the first grip 38 and the second grip 39 are projected outward more than the outer casing portion 100C when the image forming apparatus is viewed from the longitudinal direction of the cartridge. For that reason, the user can perform the mounting operation of the cartridge 33 without inserting his (her) hands into the inside of the apparatus main assembly 100A. Further, when the torsion coil spring (urging member) 52 or the like described above is used, the user can perform the demounting operation without inserting his (her) hands into the inside of the apparatus main assembly 100A. The first grip 38 and the second grip 39 are configured to be rotatable to the retracted position as described above and therefore the first grip 38 and the second grip 39 may be projected to the outside of the outer casing portion 100C of the apparatus main assembly.

When the mounting operation of the cartridge 33 is ended, the user closes the cover 10. FIG. 18 shows a partly closed state of the cover 10, in which the cover 10 is not completely closed.

As shown in FIG. 18, the cover 10 contacts the first grip 38 and the second grip 39 to rotate the first grip 38 and the second grip 39 about the rotational shafts 38*a* and 39*a*. The first grip 38 and the second grip 39 are provided with force receiving portions for receiving a force in contact with the cover 10 at their ends, i.e., force receiving portions 38*f* and 39*f* for receiving a force, from the cover 10, for rotating the grips 38 and 39 from the projected position to the retracted position (FIG. 19A). As a result, the first grips 38 and the second grips 39 are successively rotated from the projected position to the retracted position from the cartridge close to the hinge shaft 10*a* of the cover 10. In this embodiment, the cartridges start rotation in the order of 33K, 33C, 33M and 33Y to more from the projected position to the retracted position. Here, as shown in FIG. 19B, a rotational axis L4 of the cover 10 and axial lines L7 cross each other when they are projected on the same plane. FIG. 19A is a schematic view when the image forming apparatus shown in FIG. 18 is viewed from above, and FIG. 19B is a perspective view thereof. At end portions of the cover 10, inclined surfaces 10*f* and 10*g* which are inclined with respect to a flat surface portion 10*e* of the cover 10 are provided. These inclined surfaces 10*f* and 10*g* function as a force applying portion for retracting the grip in contact with the grip when the cover 10 covers the cartridge mounting and demounting opening. That is, the inclined surfaces 10*f* and 10*g* contact the first grip 38 and the second grip 39, so that a force around the rotational shafts 38*a* and 39*a* is generated to rotate the first grip 38 and the second grip 39. Here, the inclined surfaces 10*f* and 10*g* function as the force applying portion, and the ends of the first grip 38 and the second grip 39 for receiving the force from the inclined surfaces 10*f* and 10*g* function as the force receiving portions 38*f* and 39*f*. That is, as described above, even when the rotation axis L4 of the cover 10 crosses the rotational shafts 38*a* and 39*a*, by providing the inclined surfaces 10*f* and 10*g*, it is possible to generate moment around the rotational shafts 38*a* and 39*a*. Therefore, it is possible to rotate the first grip 38 and the second grip 39 so as to be retracted with respect to the longitudinal direction. The user can rotate the first grip 38 and the second grip 39 from the projected position to the retracted position by the closing operation of the cover 10, so that the grips 38 and 39 are excellent in ease of handling compared with the conventional constitution.

When the cover 10 is further rotated, the first grip 38 and the second grip 39 pass through the inclined surfaces 10*f* and 10*g* and receive the force from the flat surface portion 10*e*. At this time, the force receiving portions 38*f* and 39*f* are located at positions deviated from the rotational shafts 38*a* and 39*a* with respect to the longitudinal direction, so that the grips 38 and 39 can rotate on the flat surface portion 10*e* even when the contact surface is not the inclined surface.

As shown in (a) of FIG. 12, the positions of the force receiving portions 38 and 39 are originally deviated from the rotational shafts 38*a* and 39*a* toward the inside with respect to the longitudinal direction of the cartridge 33 by ΔZ. In this case, different from the above case in which the inclined surfaces are provided, the first grip 38 and the second grip 39 can be rotated on only the flat surface portion 10*e*. That is, when the first grip 38 and the second grip 39 receive the force from the flat portion 10*e* of the cover 10, a force in the direction indicated by arrows Z3 is exerted on the force receiving portions 38*f* and 39*f*. The arrows Z3 are deviated from the rotational shafts 38*a* and 39*a* with respect to the longitudinal direction by ΔZ, so that moments M1 and M2 are generated around the rotational shafts 38*a* and 39*a*. As a result, the force for rotating the first grip 38 and the second grip 39 toward the retracted position is applied in the direction of the arrow Z3. That is, even when the rotational axis L4 and the rotational shafts 38*a* and 39*a* cross each other, the force receiving portions are deviated with respect to the longitudinal direction of the cartridge (the same direction as the direction of the axis L4), so that the first grip 38 and the second grip 39 can be rotated so as to be retracted with respect to the longitudinal direction.

In this, case, it is also possible to provide the cover 10 with the inclined surfaces 10*f* and 10*g* described above, so that the first grip 38 and the second grip 39 can be rotated to the retracted position further reliably.

In FIG. 20, each of a first grip 638 and a second grip 639 crosses aside wall 633*g* of a cartridge 633 at an angle α of less than 90 degrees. In this case, by adjusting rotation-preventing portions 638*d* and 639*d* provided to the first grip 638 and the second grip 639, the angle α is set at a value of less than 90 degrees at the projected portion with respect to the longitudinal direction. Therefore, the positions of the force receiving portions 638*f* and 638*f* are deviated from the rotational shafts 638*a* and 639*a* with respect to the longitudinal direction of the cartridge 633, so that the first grip 638 and the second grip 639 can be rotated on only the flat surface portion 10*e* without providing the inclined surfaces 10*f* and 10*g* similarly as in the above case. On the other hand, the inclined surface 10*f* and 10*g* may also be provided as described above in this case, so that the first grip 638 and the second grip can be rotated further reliably to the retracted position.

As described above, even when the rotational axis L4 of the cover 10 and the rotational shafts 38*a* and 39*a* cross each other, the first grip 38 (638) and the second grip (639) receive the force at the force receiving portions 38*f* (638*f*) and 39*f* (639*f*) to rotate about the rotational shafts 38*a* (638*a*) and 39*a* (639*a*), thus moving from the projected position to the retracted position.

Further, the first and second grips 38 and 39 which have been rotated to the retracted position are located at a retracted portion 40 between adjacent exposure windows of the plurality of exposure windows 10*h*1 to 10*h*4 (FIG. 1B). The retracted portion 40 is located between the adjacent exposure windows with respect to the direction indicated by an arrow Xl, and is located between the side wall 33*g* ((a) and (b) of FIG. 5) and the scanner unit 11 with respect to the direction indicated by an arrow Z1 perpendicular to the direction of the arrow X1. Therefore, the laser beam L (LY, LM, LC, LK) emitted from the scanner unit 11 is not blocked by the first grip 38 and the second grip 39 located at the retracted position. That is, by employing the constitution for rotating the first grip 38 and the second grip 39 with respect to the longitudinal direction, i.e., the constitution for rotating the grips 38 and 39 with respect to the rotational axis direction of the drum 32*a* (or a main scan direction of the exposure device), the above effect was able to be achieved. In this embodiment, the first grip 38 and the second grip 39 are configured so as not to overlap with the respective exposure windows 10*h*1 to 10*h*4 with respect to the direction of the arrow X1 but may also overlap with the windows 10*h*1 to 10*h*4 so long as the grips 38 and 39 do not block the emitted light beam.

In this embodiment, each of the exposure windows 10*h*1 to 10*h*4 is a through hole provided in the cover 10 but a dust-proofing glass for preventing dust (toner or the like from entering the scanner unit 11 may also be formed so as to block up the through hole. Or, an exposure shutter for opening the exposure windows 10*h*1 to 10*h*4 during the image formation and closing the exposure windows 10*h*1 to 10*h*4 during the opening of the cover 10. As a result, the entrance of the dust into the scanner unit 11 can be prevented more effectively.

As described above, by employing the constitution in which the first grip 38 and the second grip 39 are located at the retracted portion 40 in the retracted position, the large projection amount of each grip at the projected position can be ensured and the light emitted from the scanner unit 11 is not blocked. That is, the ease of handling of the cartridge by the user can be improved without adversely affecting the image formation. In this embodiment, the transfer member is the intermediary transfer member 34 for transferring the image indirectly onto the recording material S from the drum 32*a*. However, this is not inevitable, and it may be of the type of transferring the image directly onto the recording material S from the drum 32*a*. At this time, the transfer member 34 transfers the developed image directly from the drum 32*a* onto the recording material S. Further, in this embodiment, the constitution of the cartridge 33 in the discrete type process cartridge is described as that of the unit which is detachably mountable to the apparatus main assembly of the image forming apparatus. In addition thereto, the present invention is also applicable to other units so long as the units can be demountable mounted to the apparatus main assembly of the image forming apparatus. For example, it is also possible to employ the constitution of the integral type process cartridge in which the photosensitive member unit 32 and the developing cartridge 33 are integrally exchanged.

While the invention has been described with reference to the structures disclosed herein, it is not confined to the details set forth, and this application is intended to cover such modification or changes as may come within the purposes of the improvements or the scope of the following claims.

This application claims priority from Japanese Patent Applications Nos. 292805/2009 filed Dec. 24, 2009 and 238733/2010 filed Oct. 25, 2010, which are hereby incorporated by reference.

What is claimed is:

1. A unit detachably mountable to a main assembly of an image forming apparatus including an openable member capable of opening and closing a unit mounting and demounting opening, said unit comprising:

a rotatable member for bearing a developer;

a side wall formed by a frame of said unit, said side wall extending in a longitudinal direction of said rotatable member;

a grip portion provided rotatably about a rotational shaft on said side wall, said grip portion being rotatably moved (i) to a projected position in which said grip portion is projected from said side wall and (ii) to a retracted position in which said grip portion is retracted in a longitudinal direction so as to be closer to said side wall than when in the projected position; and a force receiving portion at which said grip portion located at the projected position receives a force from the openable member when said openable member is closed in a state in which said unit is mounted in the main assembly, said force receiving portion being configured to receive the force for rotating said grip portion from the projected position to the retracted position.

2. A unit according to claim 1, wherein said grip portion extends in a direction crossing a longitudinal direction of said unit at the projected position.

3. A unit according to claim 1, wherein said grip portion located at the projected position has an amount of projection from said side wall that is larger than a thickness of said side wall with respect to a widthwise direction of said side wall perpendicular to a longitudinal direction of said unit.

4. A unit according to claim 1, wherein said frame of said unit includes a preventing portion, provided at the projected position, for preventing rotation of said grip portion in a direction opposite from a direction of the rotation of said grip portion from the projected position to retracted position, and wherein said grip portion includes a portion-to-be-prevented for preventing the rotation of said grip portion in contact with said preventing portion.

5. A unit according to claim 1, further comprising a friction member for generating a frictional force against the rotation of said grip portion when said grip portion is rotated from the projected position to the retracted position.

6. A unit according to claim 1, further comprising an urging member for urging said grip portion from the retracted position to the projected position.

7. A unit detachably mountable to a main assembly of an image forming apparatus including an openable member capable of opening and closing a unit mounting and demounting opening, said unit comprising:

a grip portion provided rotatably about a rotational shaft on a side wall of a frame of said unit, said grip portion being rotatably moved (i) to a projected position in which said grip portion is projected from said side wall and (ii) to a retracted position in which said grip portion is retracted in a longitudinal direction so as to be closer to said side wall than when in the projected position; and a force receiving portion at which said grip portion located at the projected position receives a force from the openable member when said openable member is closed in a state in which said unit is mounted in the main assembly, said force receiving portion being configured to receive the force for rotating said grip portion from the projected position to the retracted position, wherein said force receiving portion is located a position in which said force receiving portion is deviated from said rotational shaft with respect to a longitudinal direction of said unit when said grip portion is located at the projected position.

8. A unit detachably mountable to a main assembly of an image forming apparatus including an openable member capable of opening and closing a unit mounting and demounting opening, said unit comprising:

a grip portion provided rotatably about a rotational shaft on a side wall of a frame of said unit, said grip portion being rotatably moved (i) to a projected position in which said grip portion is projected from said side wall and (ii) to a retracted position in which said grip portion is retracted in a longitudinal direction so as to be closer to said side wall than when in the projected position; and a force receiving portion at which said grip portion located at the projected position receives a force from the openable member when said openable member is closed in a state in which said unit is mounted in the main assembly, said force receiving portion being configured to receive the force for rotating said grip portion from the projected position to the retracted position, wherein said grip portion includes a supporting portion for supporting a weight of said unit at the projected position, and wherein said frame of said unit includes a portion-to-be-supported for being supported by said supporting portion.

9. A unit detachably mountable to a main assembly of an image forming apparatus including an openable member capable of opening and closing a unit mounting and demounting opening, said unit comprising:

a grip portion provided rotatably about a rotational shaft on a side wall of a frame of said unit, said grip portion being rotatably moved (i) to a projected position in which said grip portion is projected from said side wall and (ii) to a retracted position in which said grip portion is retracted in a longitudinal direction so as to be closer to said side wall than when in the projected position; and a force receiving portion at which said grip portion located at the projected position receives a force from the openable member when said openable member is closed in a state in which said unit is mounted in the main assembly, said force receiving portion being configured to receive the force for rotating said grip portion from the projected position to the retracted position, wherein said frame of said unit includes a locking portion for locking said grip portion when said grip portion is located at the projected position, wherein said grip portion includes a portion-to-be-locked for being locked by said locking portion, and wherein said portion-to-be-locked is disengaged from said locking portion when said grip portion is retracted to the retracted position.

10. A unit detachably mountable to a main assembly of an image forming apparatus including an openable member capable of opening and closing a unit mounting and demounting opening, said unit comprising:

a grip portion provided rotatably about a rotational shaft on a side wall of a frame of said unit, said grip portion being rotatably moved (i) to a projected position in which said grip portion is projected from said side wall and (ii) to a retracted position in which said grip portion is retracted in a longitudinal direction so as to be closer to said side wall than when in the projected position; and a force receiving portion at which said grip portion located at the projected position receives a force from the openable member when said openable member is closed in a state in which said unit is mounted in the main assembly, said force receiving portion being configured to receive the force for rotating said grip portion from the projected position to the retracted position, wherein said rotational shaft of said grip portion has an upper end tilted toward the projected position with respect to a vertical direction.

11. An image forming apparatus, in which a unit is to be mounted, for forming an image on a recording material, said image forming apparatus comprising:

a unit;

a unit mounting portion for mounting said unit in said image forming apparatus; and an openable member capable of opening and closing a unit mounting and demounting opening, wherein said unit comprises:

a rotatable member for bearing a developer;

a side wall, formed by a frame of said unit, extending in a longitudinal direction of said rotatable member;

a grip portion provided rotatably about a rotational shaft on said side wall, said grip portion being rotatably moved (i) to a projected position in which said grip portion is projected from said side wall and (ii) to a retracted position in which said grip portion is retracted in a longitudinal direction so as to be closer to said side wall than when in the projected position; and a force receiving portion at which said grip portion located at the projected position receives a force from said openable member when said openable member is closed in a state in which said unit is mounted in a main assembly of said image forming apparatus, said force receiving portion being configured to receive the force for rotating said grip portion from the projected position to the retracted position.

12. An apparatus according to claim 11, wherein said openable member includes a force applying portion for applying a force to a force receiving portion provided on said unit, said force applying portion in contact with said force receiving portion when said openable member closes said unit mounting and demounting opening.

13. An apparatus according to claim 11, wherein in a state in which said unit is mounted in a main assembly of said image forming apparatus and then said openable member is opened, said grip portion is projected outside another casing portion of said main assembly at the projected position when said image forming apparatus is viewed from a longitudinal direction of said unit.

14. An apparatus according to claim 11, further comprising:

a plurality of photosensitive drums;

an exposure unit for forming a latent image on said photosensitive drums; and a plurality of exposure windows provided between said exposure unit and said photosensitive drums, wherein said grip portion is located, when the grip portion is at the retracted position in a state in which said unit is mounted in a main assembly of said image forming apparatus, at a position in which light emitted from said exposure units is not blocked.

15. An apparatus An image forming apparatus, in which a unit is to be mounted, for forming an image on a recording material, said image forming apparatus comprising:

a unit;

a unit mounting portion for mounting said unit in said image forming apparatus; and an openable member capable of opening and closing a unit mounting and demounting opening, wherein said unit comprises:

a grip portion provided rotatably about a rotational shaft on a side wall of a frame of said unit, said grip portion being rotatably moved (i) to a projected position in which said grip portion is projected from said side wall and (ii) to a retracted position in which said grip portion is retracted in a longitudinal direction so as to be closer to said side wall than when in the projected position; and a force receiving portion at which said grip portion located at the projected position receives a force from said openable member when said openable member is closed in a state in which said unit is mounted in a main assembly of said image forming apparatus, said force receiving portion being configured to receive the force for rotating said grip portion from the projected position to the retracted position, wherein said openable member is provided rotatably about a rotational shaft, and wherein said rotational shaft of said openable member and said rotational shaft of said grip portion cross each other when said rotational shaft of said openable member and said rotational shaft of said grip portion are projected on the same plane.

* * * * *